US009932045B2

(12) United States Patent
Geddie et al.

(10) Patent No.: US 9,932,045 B2
(45) Date of Patent: Apr. 3, 2018

(54) LOADING PLATFORM THAT MITIGATES GAP FOR PASSENGERS

(71) Applicant: NATIONAL RAILROAD PASSENGER CORP., Washington, DC (US)

(72) Inventors: John D. Geddie, Howell, MI (US); Brian A. Moore, Holly, MI (US); Larry Firlik, Madison Height, MI (US); Jay Winborn, Madison Heights, MI (US); Christopher Kattola, Shelby Township, MI (US); Robert Kokx, Rochester Hill, MI (US); Chris Dowdey, Madison Heights, MI (US); Alex Wittur, Madison Heights, MI (US); Gary Talbot, Wilmington, DE (US); Kyle Giannaula, Philadelphia, PA (US); Greg Ford, Madison Heights, MI (US); Greg Leitz, Madison Heights, MI (US); Daniel L. Costea, Farmington Hills, MI (US)

(73) Assignee: NATIONAL RAILROAD PASSENGER CORP., Washington, DC (US)

( * ) Notice: Subject to any disclaimer, the term of this patent is extended or adjusted under 35 U.S.C. 154(b) by 347 days.

(21) Appl. No.: 14/682,927

(22) Filed: Apr. 9, 2015

(65) Prior Publication Data

US 2015/0291187 A1 Oct. 15, 2015

Related U.S. Application Data

(60) Provisional application No. 61/977,808, filed on Apr. 10, 2014.

(51) Int. Cl.
*B61B 1/02* (2006.01)
*B61B 1/00* (2006.01)
(Continued)

(52) U.S. Cl.
CPC ..... *B61B 1/02* (2013.01); *B61B 1/00* (2013.01); *B61D 23/02* (2013.01); *B61K 13/04* (2013.01)

(58) Field of Classification Search
CPC .. B61B 1/00; B61B 1/02; B61D 23/02; B61K 13/04
(Continued)

(56) References Cited

U.S. PATENT DOCUMENTS 937,375 A 10/1909 Logan
1,027,107 A 5/1912 De Ryss
(Continued)

*Primary Examiner* — Zachary L Kuhfuss
(74) *Attorney, Agent, or Firm* — Hauptman Ham, LLP

(57) ABSTRACT

Systems and methods for a shuttle platform that is configured to allow a path for one or more passengers to load or unload from a light rail transit vehicle that runs on a shared track. The shuttle platform can move in a linear plane that is parallel to a ground level from a first position to a second position and/or the second position to the first position. The shuttle platform can be associated with a setback platform that provides a first path parallel to a centerline of the shared track and a second path parallel to the centerline of the shared track, wherein the first path is at a first height from the ground level, the second path is at a second height from the ground level, and the first path and the second path are adjacent to one another.

16 Claims, 25 Drawing Sheets

(51) Int. Cl.
*B61D 23/02* (2006.01)
*B61K 13/04* (2006.01)

(58) Field of Classification Search
USPC ..... 104/31
See application file for complete search history.

(56) References Cited

U.S. PATENT DOCUMENTS

| | | | | |
|---|---|---|---|---|
| 1,027,828 | A | 5/1912 | De Ryss | |
| 1,050,937 | A | 1/1913 | Gallinant | |
| 1,098,298 | A | 5/1914 | Porth | |
| 1,149,759 | A | 8/1915 | Hedley et al. | |
| 1,216,560 | A | 2/1917 | Gallinant | |
| 5,517,921 | A | 5/1996 | Klohn | |
| 5,845,579 | A | 12/1998 | Langley et al. | |
| 5,845,580 | A | 12/1998 | Muller et al. | |
| 2001/0042489 | A1 | 11/2001 | Yamaguchi et al. | |
| 2010/0043664 | A1 | 2/2010 | Winkelmann et al. | |
| 2010/0058949 | A1 | 3/2010 | Lomberty et al. | |
| 2012/0120234 | A1* | 5/2012 | Fullalove | B61B 1/02 348/143 |

* cited by examiner

LOADING PLATFORM THAT MITIGATES GAP FOR PASSENGERS

CROSS-REFERENCE TO RELATED APPLICATIONS

This application claims the benefit of U.S. Provisional Application Ser. No. 61/977,808 filed on Apr. 10, 2014, the entirety of which are incorporated herein by reference.

BACKGROUND

Technical Field

Embodiments of the subject matter disclosed herein relate to a shuttle platform that actuates from a first position to a second position to facilitate loading a light rail transit vehicle on a shared track rail system.

Discussion of Art

Shared track rail systems are used by freight rail vehicles that transport non-human cargo and light rail transit vehicles transport passengers. Based on the various types of rail vehicles that are used by the freight rail vehicles and the light rail transit vehicles, regulations exist for shared track rail systems compared to rail systems that are exclusive to one of freight rail vehicles or light rail transit vehicles. In particular, the Federal Railroad Administration (FRA) regulates a distance from a centerline of a shared track rail system to a platform depending on if the platform is a setback platform (e.g., above-ground level) or a level boarding platform (e.g., approximately on ground level).

In light of such FRA regulations, problems and difficulty arise with loading and alighting light rail transit vehicles. For instance, a conventional light rail transit vehicle includes a steep incline of steps to board, which can prove difficult for entry and exit. In another instance, individuals with wheeled mobility devices (e.g., wheelchair, motorized assistance vehicle, etc.) are unable to enter or exit the light rail transit without a ramp or a bridge plate. A setback platform also adds additional problems and difficulty based on having a gap between the front of the setback platform and the centerline of the shared rail track system based on the FRA regulation(s).

In light of these FRA regulations that create difficulties with loading and alighting light rail transit vehicles, what is needed is a solution that allows passengers (e.g., with or without wheeled mobility devices) to enter and exit a light rail transit vehicle with ease without a steep incline or concern of a large gap between the platform and the light rail transit vehicle.

BRIEF DESCRIPTION

In an embodiment, a setback platform system for a shared track rail system on a ground level that is used by a light rail transit vehicle and a freight vehicle is provided. The setback platform system can include: a setback platform that is substantially parallel to the shared track rail system and is a first distance from a centerline of the shared track rail system; a first path at a first height along and on top of the setback platform; a shuttle platform coupled to the setback platform that actuates from a first position to a second position with a linear movement toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height; in the first position, a portion of the shuttle platform is situated below the first path and the front edge is a second distance from the centerline; in the second position, the portion of the shuttle platform is adjacent to the first path and the front edge is a third distance from the centerline; the shuttle platform provides a path in the second position to allow passengers to board the light rail transit vehicle; and the shuttle platform in the first position creates a second path that allows travel about the setback platform.

In an embodiment, a setback platform is provided for a shared track rail system on a ground level that is used by a light rail transit vehicle and a freight vehicle. The setback platform system can include at least one of the following: a setback platform that is substantially parallel to the shared track rail system and is approximately nine (9) feet from a centerline of the shared track rail system; a first path at a first height along and on top of the setback platform; a shuttle platform coupled to the setback platform that actuates from a first position to a second position with a linear movement via a guide system driven by a drive component toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height; the shuttle platform includes a top section positioned above a bottom section, wherein the top section and the bottom section are integrated into the setback platform and the bottom section includes the guide system; in the first position, a portion of the shuttle platform is situated below the first path and the front edge is approximately nine (9) feet from the centerline; in the second position, the portion of the shuttle is adjacent to the first path and the front edge is a distance from the centerline, wherein the distance is between five (5) feet six (6) inches and five (5) eight (8) inches; the shuttle platform provides a path in the second position to allow passengers to board the light rail transit vehicle; and the shuttle platform in the first position creates a second path that allows travel about the setback platform.

In an embodiment, a method is provided for a setback platform system that actuates the shuttle platform from a first position to a second position in a linear motion parallel to a ground level toward a centerline of a shared track rail system to allow unloading and/or loading of one or more passengers with a light rail transit vehicle. In an embodiment, a method is provided for a setback platform system that actuates the shuttle platform from a second position to a first position in a linear motion parallel to a ground level away from a centerline of a shared track rail system to allow a light rail transit vehicle to depart from a setback platform system and/or allow for clearance of a freight vehicle that uses the shared track rail system.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
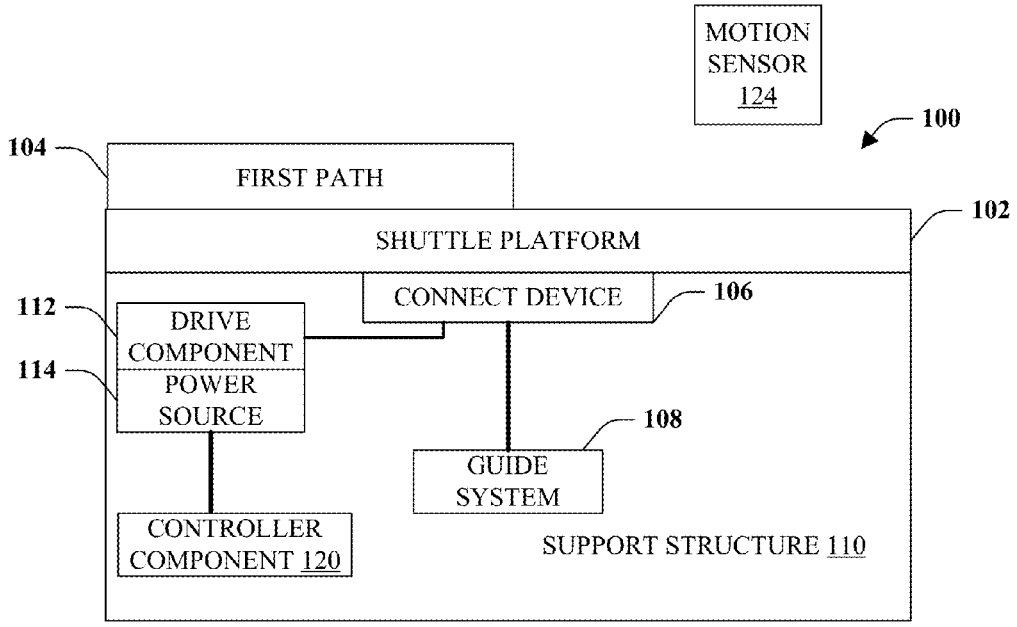
FIG. 1 is an illustration of a setback platform system, in a cross-sectional view, that includes a shuttle platform in a first position in accordance with the subject innovation.

Embodiments of the present invention relate to methods and systems for a shuttle platform that is configured to allow a walkway for one or more passengers to load or unload from a light rail transit vehicle that runs on a shared track. The shuttle platform can move in a linear plane that is parallel to a ground level from a first position to a second position and/or the second position to the first position. The shuttle platform can be associated (e.g., coupled, attached, releasably coupled, etc.) with a setback platform that provides a first path parallel to a centerline of the shared track and a second path parallel to the centerline of the shared track, wherein the first path is at a first height from the ground level, the second path is at a second height from the ground level, and the first path and the second path are adjacent to one another. It is to be appreciated that a portion of the shuttle platform comprises the second path. Moreover, the first height is greater than the second height to enable the shuttle platform to slide in a linear motion from the first position to the second position in which the first position includes a portion of the shuttle platform to be underneath the first path.

The first position can be a non-loading position in which a portion of the shuttle platform is underneath a portion of the first path. In the non-loading position, the shuttle platform is not deployed and a distance of approximately nine (9) feet is between a front edge of the shuttle platform and the centerline of the shared track. In an embodiment, the shuttle platform can include one or more railings that serve as a visual warning and physical protection for safety. In another embodiment, the shuttle platform can include one or more motion sensors such that a detected motion can indicate an alert to prevent movement of the shuttle platform.

With reference to the drawings, like reference numerals designate identical or corresponding parts throughout the several views. However, the inclusion of like elements in different views does not mean a given embodiment necessarily includes such elements or that all embodiments of the invention include such elements.

The term "shared track" as used herein (also referred to as a "shared track rail system") can be defined as rail track of a general railroad system that is used for both light rail transit and freight railroad operations. Although commuter rail often shares track with freight service, it uses equipment that meets different safety standards than light rail transit.

The term "vehicle" as used herein can be defined as a mobile machine or a moveable transportation device that transports at least one of a person, people, or a cargo. For instance, a vehicle can be, but is not limited to being, a rail car, an intermodal container, a locomotive, a light rail car, and the like.

The term "component" as used herein can be defined as a portion of hardware, a portion of software, or a combination thereof. A portion of hardware can include at least a processor and a portion of memory, wherein the memory includes an instruction to execute. Additionally, "component" as used herein includes, but is not limited to: any programmed, programmable, or other electronic device or portion thereof that can store, retrieve, and/or process data; one or more computer readable and/or executable instructions, stored on non-transitory computer-readable medium/media, that cause an electronic device to perform one or more functions, actions, and/or behave in a desired manner as specified in the instructions; or combinations thereof.

Figure 2:
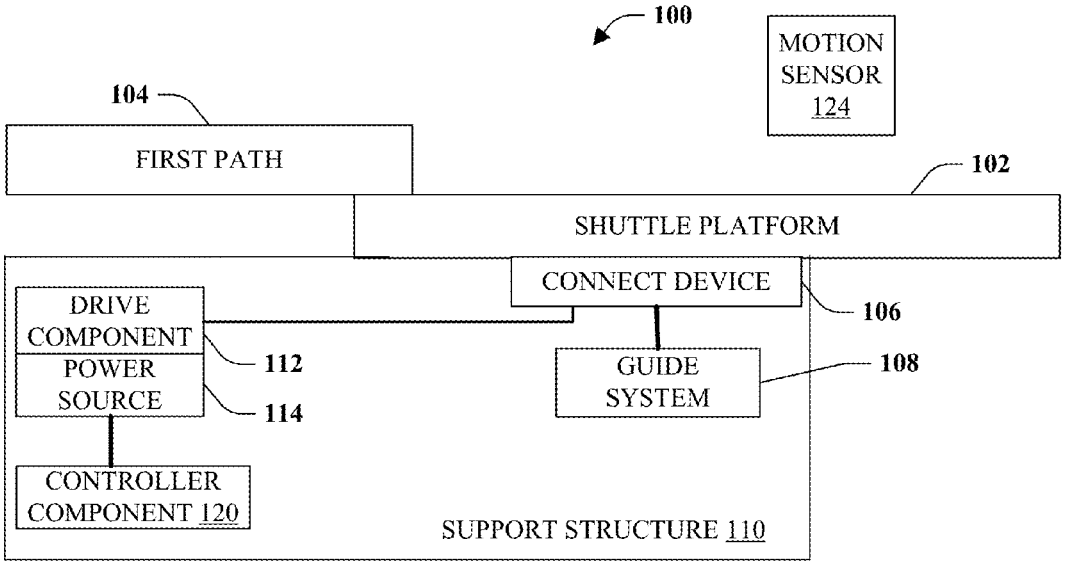
FIG. 2 is an illustration of a setback platform system, in a cross-sectional view, that includes a shuttle platform in a second position in accordance with the subject innovation.

FIGS. 1-2 illustrate cross-sectional views of a setback platform system 100. FIGS. 3-6 illustrate top views of a shuttle platform 102 in accordance with an embodiment of the subject innovation. FIG. 1 illustrates a setback platform system 100 with the shuttle platform 102 in a first position, wherein a portion of the shuttle platform 102 can be underneath a first path 104. The first path 104 and the shuttle platform 102 can provide a walkway or path for travel parallel to a centerline 506 of a shared track rail system 504 (shown in FIGS. 5 and 6). The first path 104 can be situated at a first height above the ground level. The shuttle platform 102 can include a front edge 502, a rear edge 604 opposite thereto, wherein the shuttle platform 102 is situated at a second height above the ground level 90 such that the first height is greater than the second height. For instance, the first path 104 is higher compared to the shuttle platform 102 in order to allow the shuttle platform to slide underneath the first path 104.

The setback platform system 100 can include the shuttle platform 102 and the first path 104. The setback platform system 100 can be utilized as a structure that is above ground level to allow loading and/or unloading of passengers onto a light rail transit vehicle on a shared track system. In light of FRA regulations, a distance of approximately nine (9) feet is required on shared track to allow clearance for freight vehicles and light rail transit vehicles on the shared track. Based on this regulation, a distance or gap exists between the setback platform system 100. The shuttle platform 102 incorporated into the setback platform system 100 allows for mitigation of the gap or distance by providing a motion from a first position to a second position and from the second position to the first position.

The shuttle platform 102 can include a connect device 106 that provides coupling and decoupling of the shuttle platform 102 to a drive component 112, wherein the coupling and/or decoupling can be at least one of a powered, automated, manual, or a combination thereof. The drive component 112 can move the shuttle platform 102 in a linear motion in a plane parallel to the ground level. The shuttle platform 102 can further include a guide system 108 that include one or more rail guides 302 (e.g., illustrated in FIGS. 3 and 4). For instance, in an embodiment, a shaft 304 can be used with the drive component 112 to actuate the shuttle platform 102 between the first position and the second position (and vice versa). In an embodiment, the drive component 112 can be powered by a power source 114. Further, the shuttle platform 102 can include a controller component 120 that can be configured to control motion of the shuttle platform 102. For instance, a motion sensor 124 can be used as a safety feature to detect motion so that the shuttle platform is not actuated from a first position to the second position (and/or vice versa) while motion is detected (e.g., indicating a person or object is in a path of the shuttle platform 102). Following this instance, the controller component 120 can be utilized to control motion in light of the motion sensor 124. In other example, the controller component 120 can receive and/or transmit wireless signals related to control of the shuttle platform 102. By way of example and not limitation, a signal can be communicated from a light rail transit vehicle on the shared track that indicates a request for deployment of the shuttle platform 102 from the first position to the second position. In another example, a signal can be communicated from the controller component 120 to a device associated with one or more light rail transit vehicles indicating a state of the shuttle platform 102. It is to be appreciated that the state can be, but is not limited to, a status condition, an error code, an alert, a failure notification, a portion of text, a graphic, an audible signal, a visual signal, among others.

In other example, the controller component 120 can receive and/or transmit wireless signals related to control of a heating element of one or more modular platform members that are coupled or arranged to form the setback platform system 100. It is to be appreciated that the subject innovation can include one or more controller components that can be used to manage motion, heating elements, sensors, motion sensors, railing movement, barriers, doors, lights, audible signals, weight sensors, and/or other devices, components, or systems.

In still another example, the controller component 120 can be configured to electrically lock or unlock gates, barriers, and/or turn-styles to prevent or allow entry to an area of the shuttle platform 102 or other areas of the setback platform system 100. For example, while in a loading configuration (e.g., shuttle platform 102 extended to mitigate the gap between the setback platform system 100 and a shared track), the controller component 120 can communicate an electronic signal to unlock gates, barriers, and/or turn-styles to allow passengers to enter an area of the platform. In another example, the controller component 120 can be configured to lock gates, barriers, and/or turn-styles when the shuttle platform 102 is in a non-loading configuration (e.g., shuttle platform 102 retracted from the shared track). Moreover, it is to be appreciated that the controller component 120 can utilize signals from sensors to determine whether locking or unlocking can be initiated. For example, a motion sensor, a sensor for a position of the shuttle platform 102, a sensor for movement of the vehicle on the shared track, a sensor from a conductor, a sensor from a depot or station, a sensor from vehicle; a sensor from a track; a wired signal from a device; a wireless signal from a vehicle or a device; or a combination thereof can be evaluated prior to locking or unlocking a gate, barrier, turn-style, or other means for restricting or unrestricting access to a location.

Shuttle platform 102 can include various components releasably attached or securably attached. For example, the shuttle platform 102 can include the following: a rail; a guard rail; a handrail; a fence; a barrier; a lighting fixture; a canopy; a roof; a support structure for a canopy; a support structure for a roof; a motion sensor; a weight sensor; a camera; a post; a gate; a barrier; ticket purchase device; among others.

Figure 3:
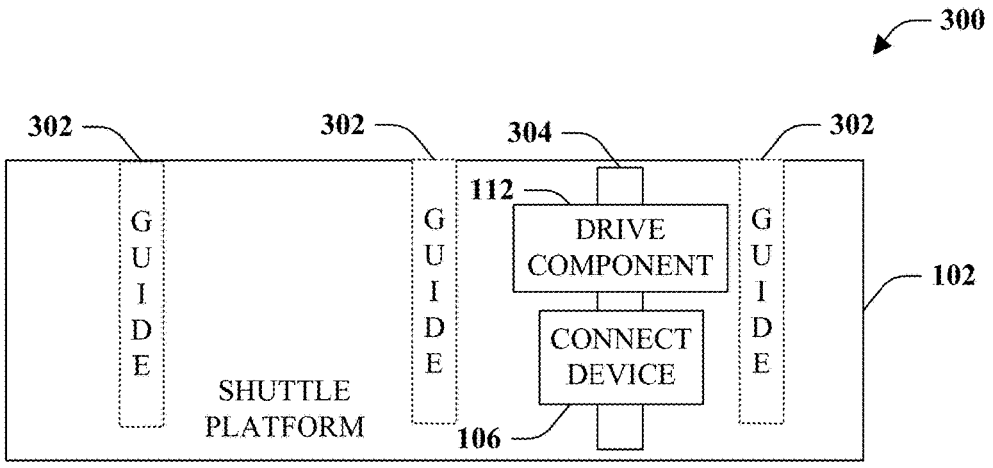
FIG. 3 is an illustration of a shuttle platform, in a top view, that includes a shuttle platform in a first position in accordance with the subject innovation.
Figure 4:
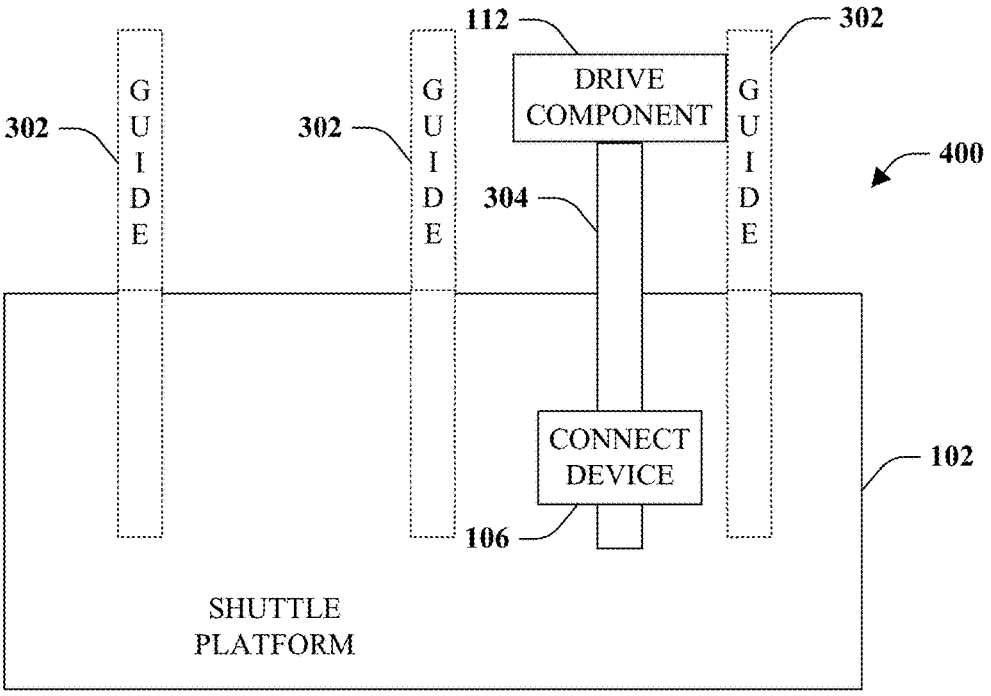
FIG. 4 is an illustration of a shuttle platform, in a top view, that includes a shuttle platform in a second position in accordance with the subject innovation.

Referring to FIGS. 1-6, the shuttle platform 102 can move from a first position (illustrated in FIG. 1) to a second position (illustrated in FIG. 2) in order to mitigate a gap 606 that exists between the front edge 502 of the shuttle platform 102 and an edge of a vehicle 602 on the shared track located at or near the setback platform system 100. FIG. 1 illustrates a cross-sectional view of the setback platform system 100 with the shuttle platform 102 in a first position that allows a freight vehicle to travel on the shared track in accordance with FRA regulations and/or allows a light rail transit vehicle to depart after loading and/or unloading passengers. FIG. 2 illustrates a cross-sectional view of the setback platform system 100 with the shuttle platform 102 in a second position that allows for loading and/or unloading of passengers to a light rail transit vehicle on a shared track rail system. FIG. 3 illustrates a top view 300 of the shuttle platform 102 without the first path 104. FIG. 4 illustrates a top view 400 of the shuttle platform 102 without the first path 104.

Figure 5:
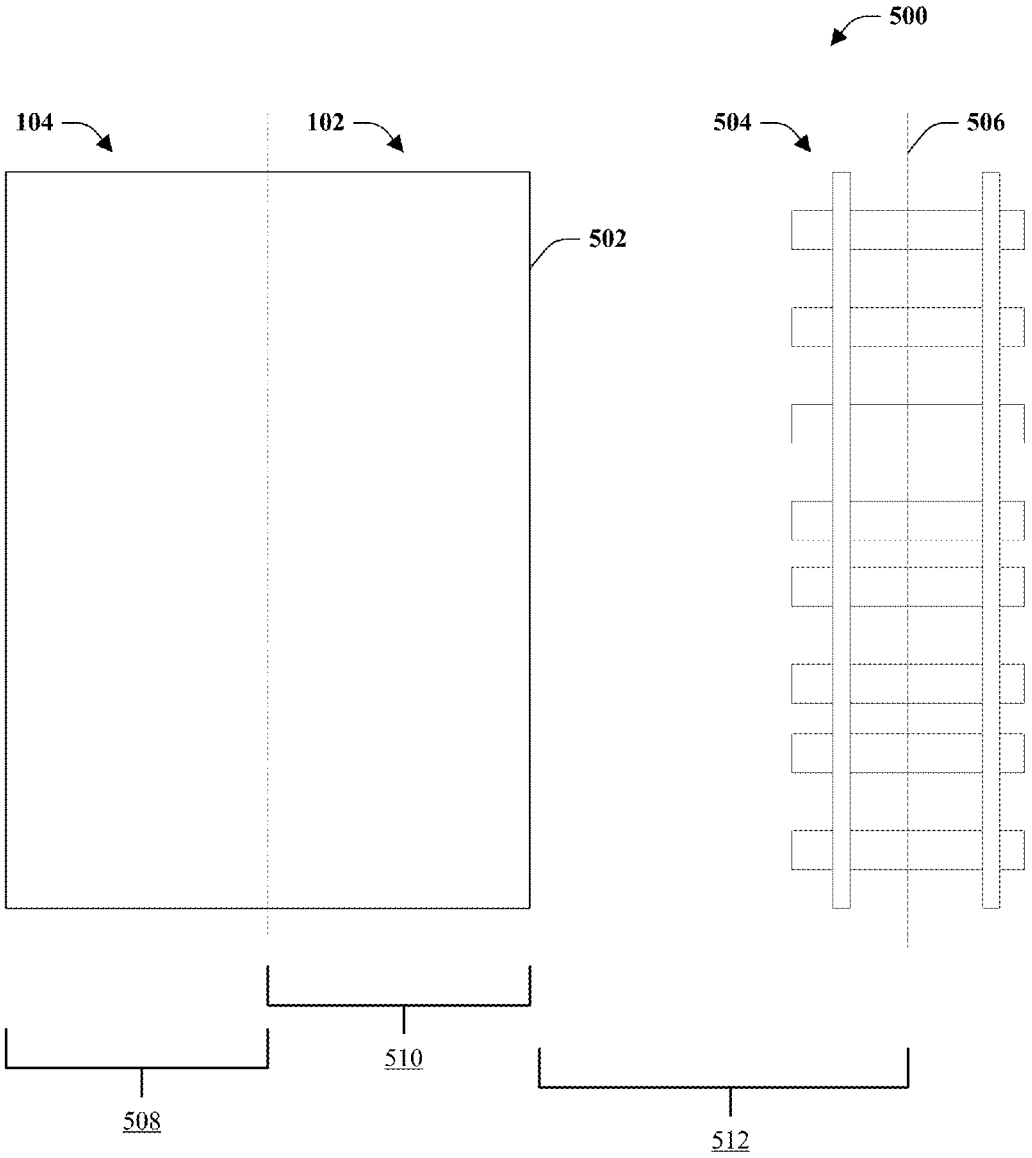
FIG. 5 is an illustration of a setback platform system, in a top view, with a shuttle platform in a first position in accordance with the subject innovation.

FIG. 5 illustrates a top view of a setback platform system 500 that illustrates a shared track rail system 504 having a centerline 506. The shuttle platform 102 can include a front edge 502 that is a distance 512 from the centerline 506. A portion 508 of the shuttle platform 102 can be underneath the first path 104 in a first position, whereas a second portion 510 of the shuttle platform 102 can be used as a second path while in the first position. In other words, while in the first position, the setback platform system 600 can include the first path 104 parallel to the centerline 506 and the second portion 510 of the shuttle platform 102 (also referred to as the second path).

While in a first position, the shuttle platform 102 can include a front edge 502 that can be approximately nine (9) feet from the centerline 506 of the shared track rail system which allows freight vehicles to travel on the shared track rail system in accordance with FRA regulations.

Figure 6:
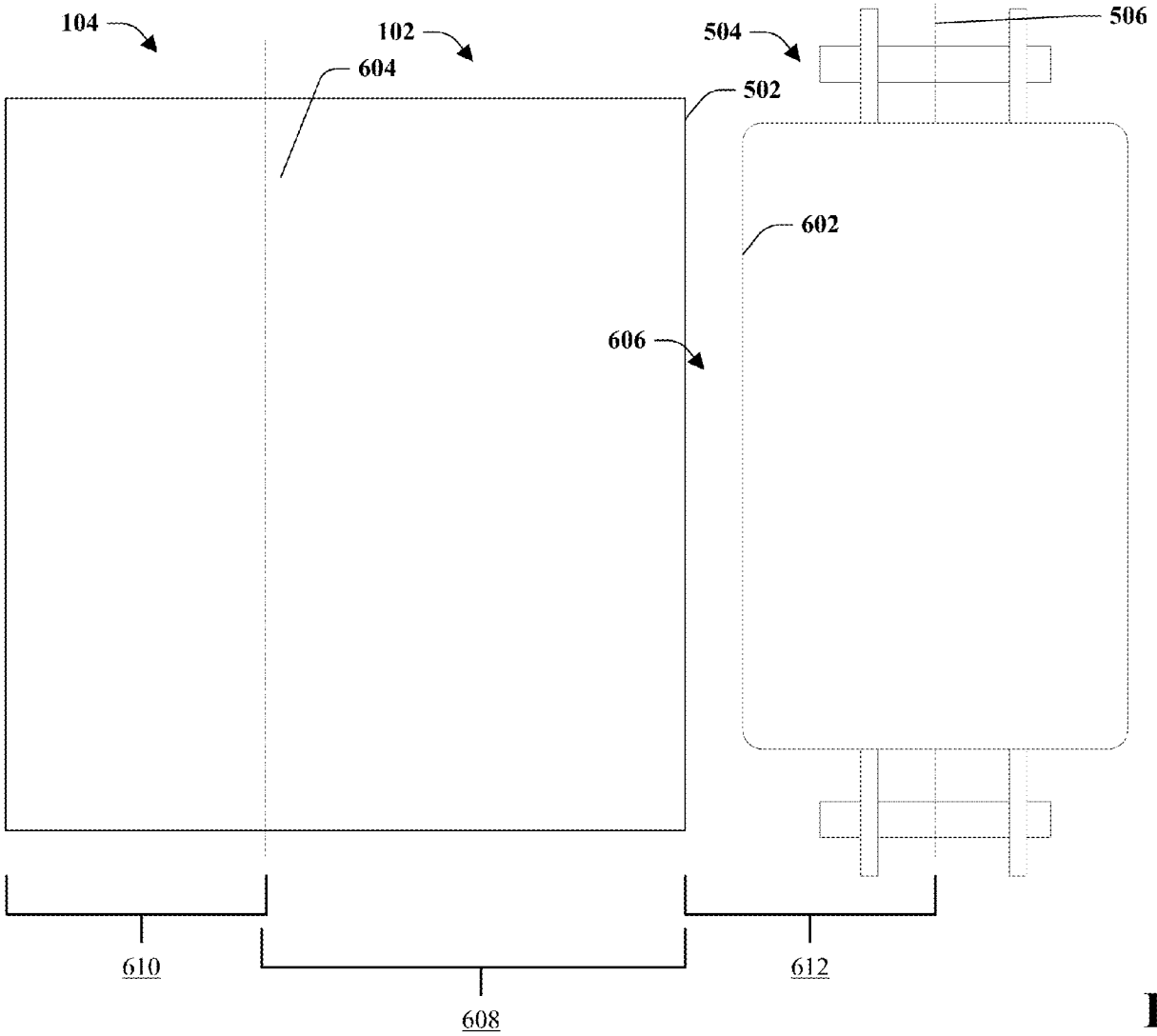
FIG. 6 is an illustration of a setback platform system, in a top view, with a shuttle platform in a second position in accordance with the subject innovation.

FIG. 6 illustrates a top view of a setback platform system 600 that illustrates the shared track rail system 504 having the centerline 506 in which a vehicle 602 is traveling thereon. The shuttle platform 102 can move in a linear motion from the first position (e.g., illustrated at least in FIGS. 1, 3, and 5) to a second position which reduces a distance or gap 606 between the front edge 502 and the vehicle 602. The linear motion of the shuttle platform 102 extends toward the centerline 506 such that a rear edge 604 of the shuttle platform is positioned adjacent and proximate a front edge (toward the centerline 506) of the first path 104. In the second position, the portion of the shuttle platform 102 that was underneath the first path 104 is extended toward the centerline 506 exposing a distance 608. By moving the shuttle platform 102 to the second position, the first path 104 still includes a distance 610 to allow passage parallel to the shared track 504 but also the shuttle platform 102 is a distance 612 from the centerline 506 which facilitates loading and/or unloading passengers onto a light rail transit vehicle that is on the shared track rail system 504.

In an embodiment, the first path 104 can be a structure that laterally extends across a length of the shuttle platform 102, wherein a portion of the shuttle platform 102 is slideably moveable from a first position to a second position. The first position can include the shuttle platform 102 having a percentage of the width positioned under or below the first path 104. While in the first position, the shuttle platform 102 can include physical structures and/or warning signals (e.g., audible, visual, etc.) to indicate the shuttle platform 102 is not in position to load passengers onto a vehicle on the shared track rail system. Upon actuation of movement to the second position, the shuttle platform 102 can slide linearly to the second position in which the percentage of the width of the shuttle platform 102 that was positioned under or below the first path 104 is not positioned under or below the first path 104.

Figure 36:
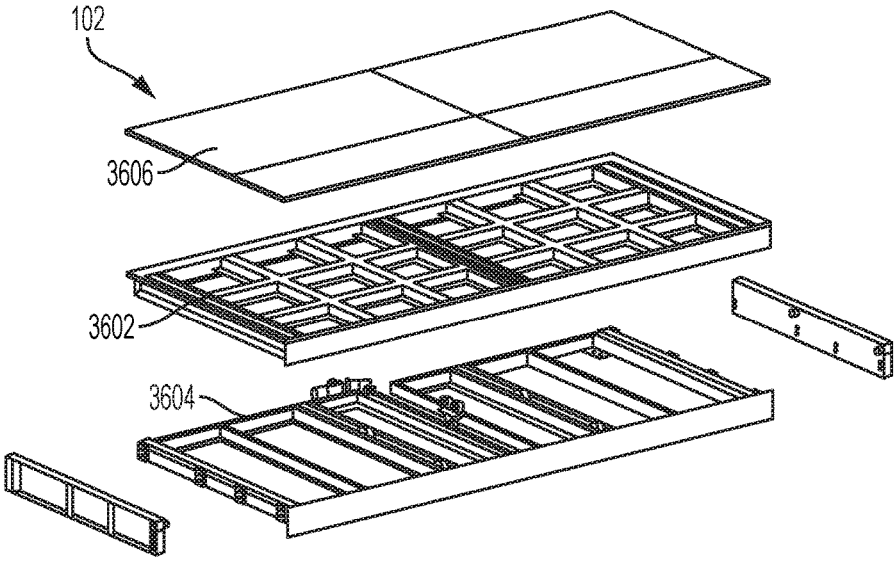
FIG. 36 is an illustration of a setback platform in accordance with the subject innovation.

Turning to FIG. 36, the shuttle platform 102 is illustrated in an exploded view. The shuttle platform 102 can include a top section 3602 and a bottom section 3604, wherein the top section is a section of the shuttle platform 102 that is slideably moveable on the guide system 108 and the bottom section is a section that houses or contains at least a portion of the guide system 108. In particular, the bottom section 3604 can incorporate the guide system 108, a portion of the connect device 106, the drive component 112, the power source 114, the controller component 120, among others. The top section 3602 or the bottom section 3604 can include a frame or frame elements for structural integrity. Moreover, the top section 3602 can include a concrete surface 3606 or other suitable surface used for passenger traffic. A section of the concrete surface 3606 or other suitable surface can be painted to provide visual indications of an edge of the shuttle platform. In an embodiment, a sensor can be utilized to indicate a location of a passenger that is close to the edge of the platform, wherein an audible or visual warning can be triggered. The shuttle platform 102 (including the top section 3602, the bottom section 3604) can be supported by the support structure 110 (illustrated in FIG. 37).

The shuttle platform 102 can be any suitable shape or size. It is to be appreciated that although the shuttle platform 102 is illustrated as a rectangle shape that holds a volume, any suitable shape can be utilized with the subject innovation. Moreover, the shuttle platform 102 can have a length, width, and thickness, wherein the shuttle platform 102 can be comprised of any suitable material. For instance, the shuttle platform 102 can be made of at least one of a concrete, a metal, a steel, a composite material, or a combination thereof. It is to be appreciated that the material composition of the shuttle platform 102 can be selected by one or ordinary skill in the art and/or with sound engineering judgment without departing from the scope of the subject innovation.

Figure 7:
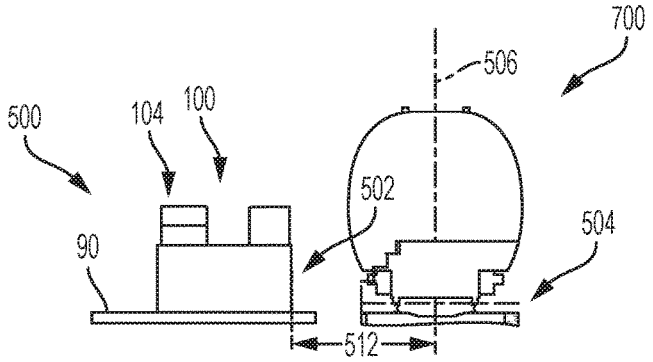
FIG. 7 is an illustration of a setback platform system, in a cross-sectional view, with a shuttle platform in a first position in accordance with the subject innovation.

FIG. 7. illustrates a side view of a setback platform system 500 that illustrates a shared track rail system 504 having a centerline 506. The shuttle platform (not shown) can include a front edge 502 that is a distance 512 from the centerline 506.

Figure 8:
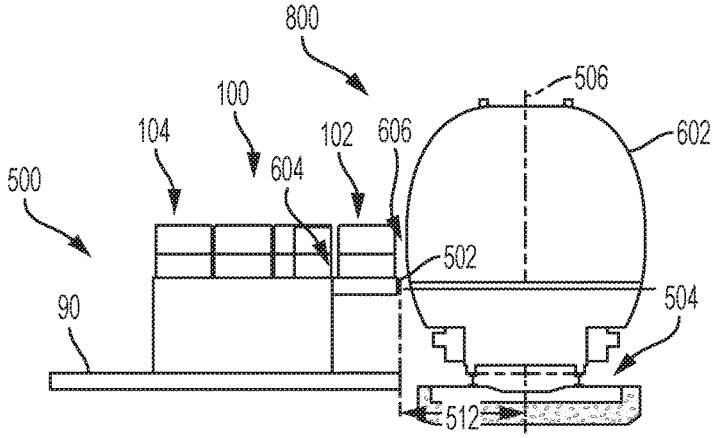
FIG. 8 is an illustration of a setback platform system, in a cross-sectional view, with a shuttle platform in a second position in accordance with the subject innovation.
Figure 9:
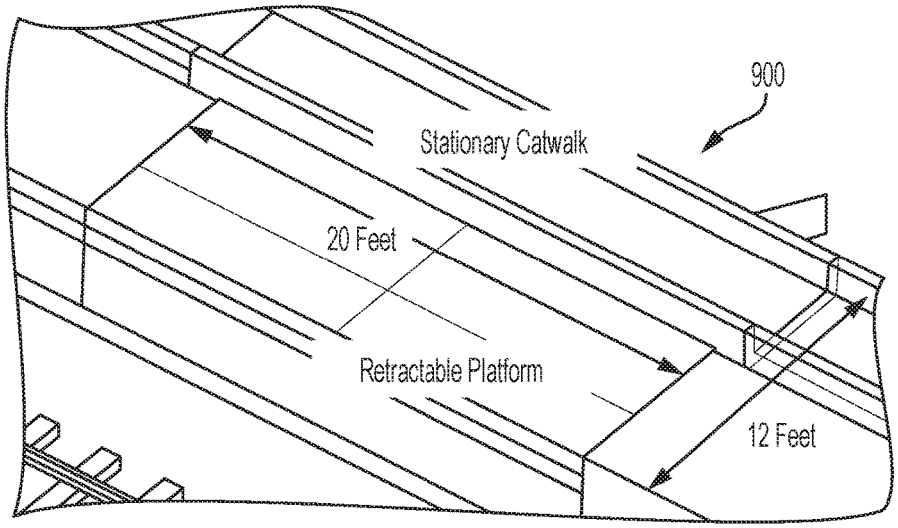
FIG. 9 is an illustration of an embodiment of a setback platform system, in a perspective view, with a shuttle platform in a first position in accordance with the subject innovation.
Figure 10:
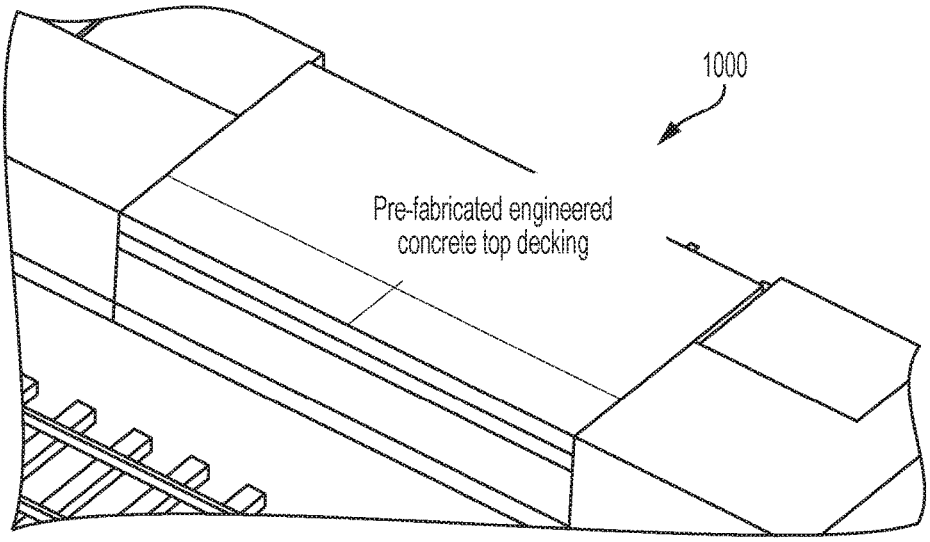
FIG. 10 is an illustration of an embodiment of a setback platform system, in a perspective view, with a shuttle platform in a first position in accordance with the subject innovation.
Figure 11:
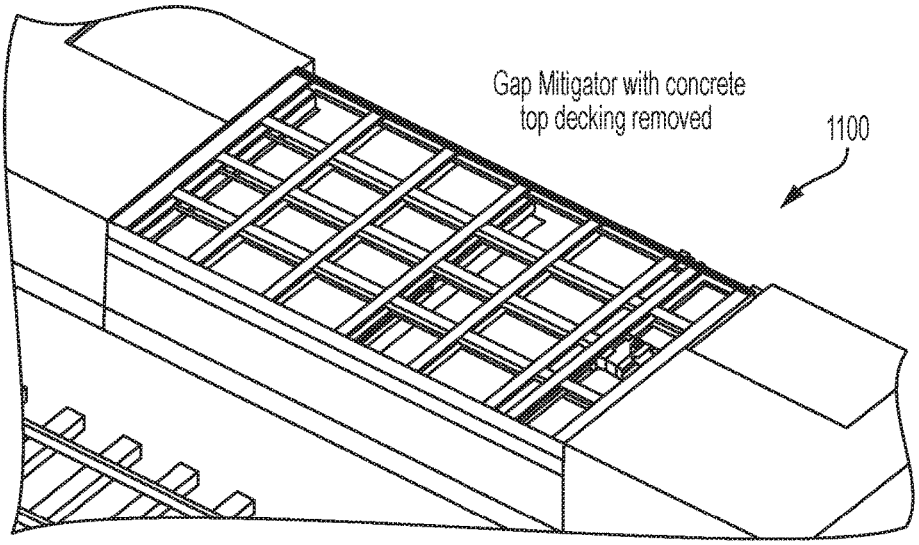
FIG. 11 is an illustration of an embodiment of a setback platform system in accordance with the subject innovation.

FIG. 8 illustrates a side view of a setback platform system 500 that illustrates the shared track rail system 504 having the centerline 506 in which a vehicle 602 is traveling thereon. The shuttle platform 102 can move in a linear motion from the first position (e.g., illustrated at least in FIGS. 1, 3, and 5) to a second position which reduces a distance or gap 606 between the front edge 502 and the vehicle 602. The linear motion of the shuttle platform 102 extends toward the centerline 506.

Figure 12:
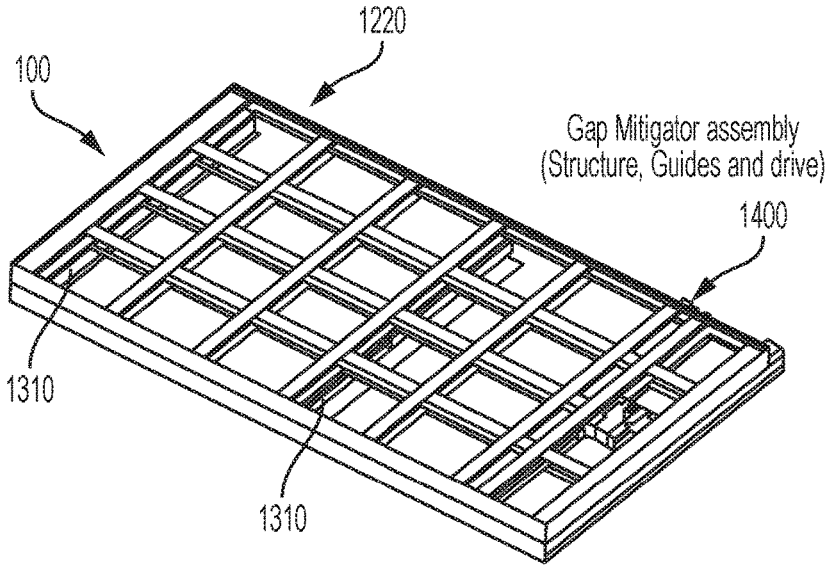
FIG. 12 is an illustration of an embodiment of a shuttle platform in accordance with the subject innovation.
Figure 30:
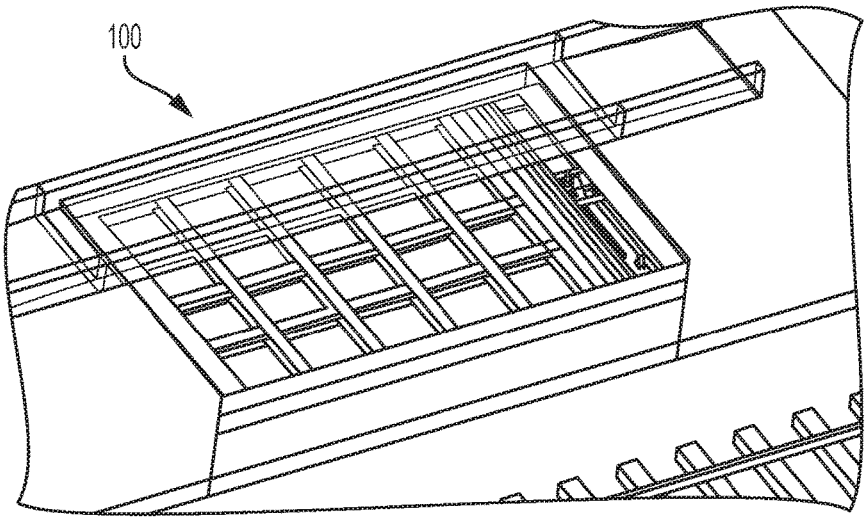
FIG. 30 is an illustration of a setback platform in accordance with the subject innovation.

Referring now to FIGS. 12 and 30, shown is one non-limiting embodiment of a setback platform system 100 with a portion of concrete removed from the shuttle platform 102 for the sake of visibility and clarity. With a portion of concrete removed from the shuttle platform 102, the infrastructural components 1220, tracking components 1310, and drive system 1400 are visible. The infrastructural components 1220 may comprise straps, beams, girders, channels, angles or other structural components chosen with good engineering judgment. The infrastructural components 1220 may comprise metal, polymer, composites, or other structural materials chosen with good engineering judgment.

In light of the above, it should be understood that, in addition to other disclosures regarding linear drive systems and actuators, there exist conventionally-known alternatives such as straight line mechanisms, and quasi-straight line mechanisms, that can also be operationally incorporated into embodiments of the present subject matter. Straight line mechanisms and quasi-straight line mechanisms, include, but are not limited to, a Peaucellier-Lipkin linkage, a Chebyshev linkage, a Hart's linkage; a Sarrus linkage; among others.

Referring now to FIGS. 13-29, shown is one non-limiting embodiment of sub-components of a setback platform system 100 for a shared track rail system 504. The sub-components in FIGS. 13-29 include, but are not limited to, a tracking component 1310, and a drive system 1400.

Figure 13:
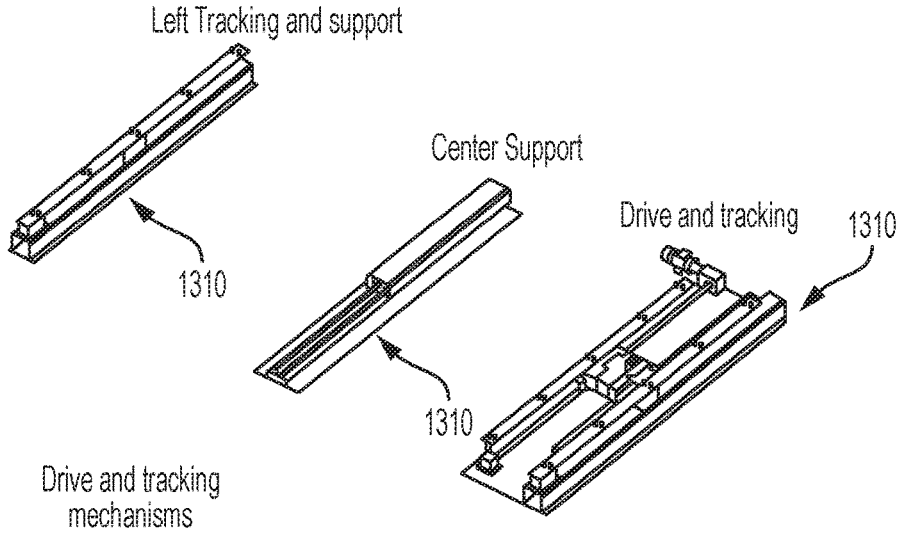
FIG. 13 is an illustration of an embodiment of a guide system for a shuttle platform in accordance with the subject innovation.
Figure 17:
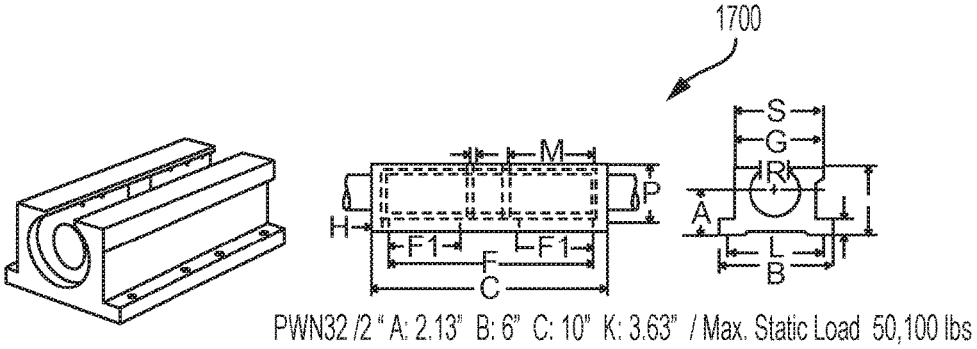
FIG. 17 is an illustration of an embodiment of a guide system for a shuttle platform in accordance with the subject innovation.

In non-limiting embodiment in FIG. 13, the setback platform system 100 can include a plurality of tracking components 1310. A tracking component 1310 is a component that can be used to: support the shuttle platform 102 with respect to the setback platform 100; and permit the shuttle platform 102 to move along a predetermined linear guide path with respect to the setback platform 100. It is to be appreciated that there can be one or more tracking component 1310. For example, three (3) tracking components 1310 are illustrated in FIG. 13 but it is to be appreciated that there can be N number of tracking components used with the subject innovation, where N is a positive integer. By way of non-limiting example, a tracking component 1310 can comprise a linear slide bearing system 1700 as shown in FIG. 17. Alternatively, a tracking component 1310 can comprise a straight line mechanism or quasi-straight line mechanism such as those referenced above, including, but not limited to, a Peaucellier-Lipkin linkage, a Chebyshev linkage, a Hart's linkage; a Sarrus linkage, or combinations thereof.

Figure 14:
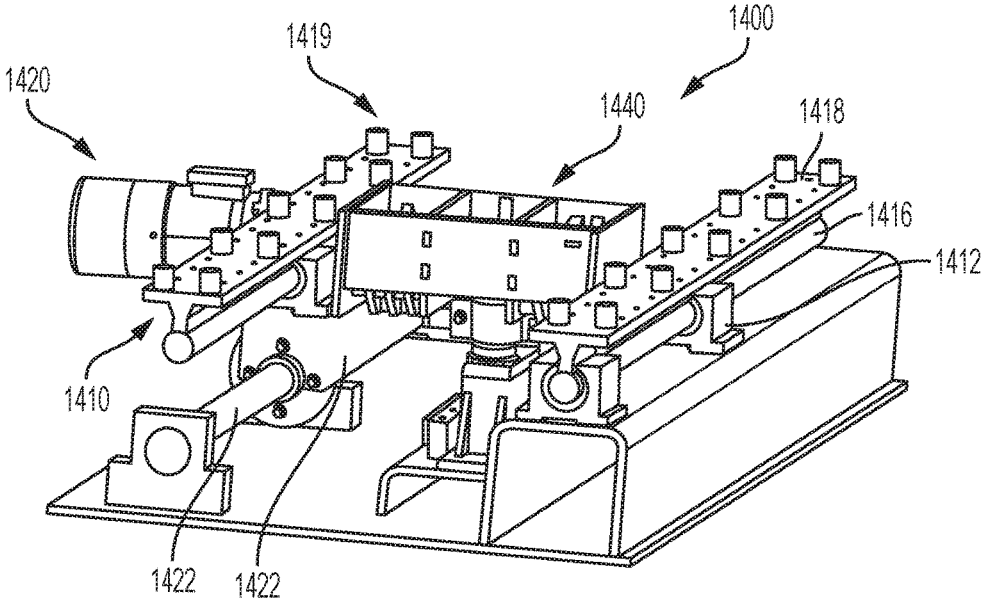
FIG. 14 is an illustration of a drive and tracking system for an embodiment of a shuttle platform in accordance with the subject innovation.

In non-limiting embodiment in FIG. 14, shown is a drive system 1400 engaged with tracking components. The tracking components in FIG. 14 are each linear slide bearing systems 1410, with each linear slide bearing systems 1410 comprising a linear bearing 1412, a linear rail 1416, and a region 1418 adapted for substantially fixed engagement with the shuttle platform 102 by fasteners 1419 or other means (e.g., brackets, bolts, screws, PLEASE INSERT MORE OPTIONS) chosen with good engineering judgment. In the non-limiting embodiment shown, the linear bearings 1412 are substantially fixedly engaged with the setback platform 100 while the linear rail 1416 and region 1418 engaged therewith are substantially fixedly engaged with the shuttle platform 102. In another embodiment, the linear bearings 1410 can be coupled to a structure and such structure can be coupled to a portion of the setback platform 100. The drive system 1400 comprises: a drive component 1420, and a combination position lock and drive mechanism disconnect 1440.

Figure 15:
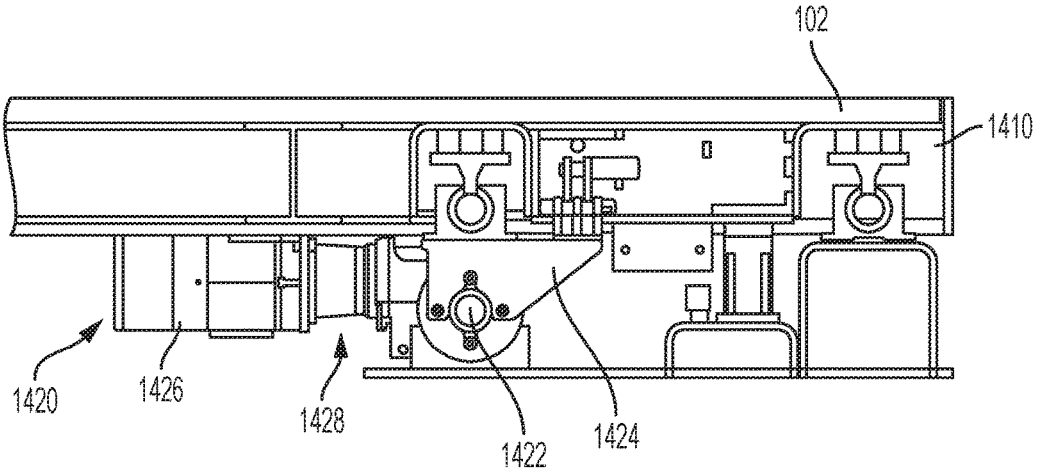
FIG. 15 is an illustration of various components of an embodiment of a shuttle platform in accordance with the subject innovation.
Figure 16:
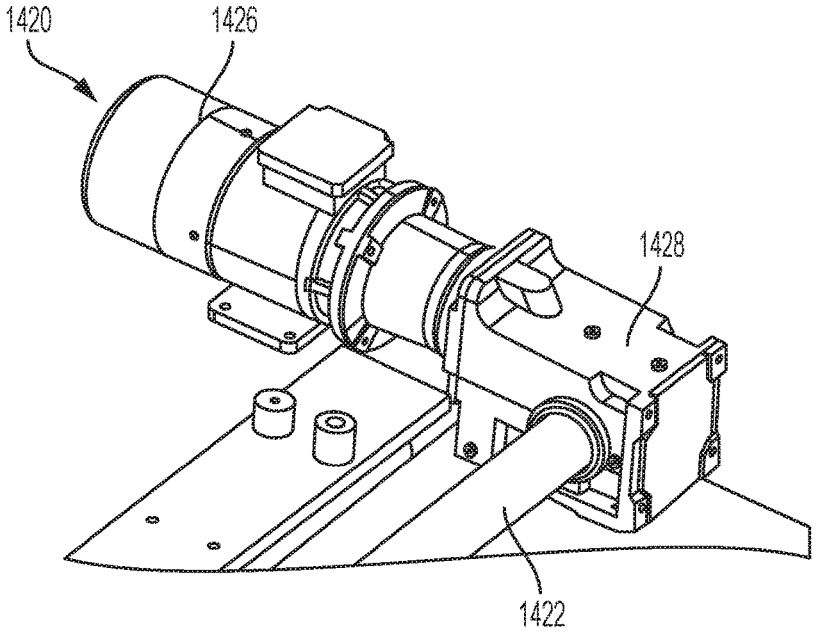
FIG. 16 is an illustration of an embodiment of a drive component used with a shuttle platform in accordance with the subject innovation.

In non-limiting embodiment in FIG. 15, shown is a different view of the drive system 1400 engaged with the linear slide bearing systems 1410, as well as the shuttle platform 102. In FIG. 15, a work output 1422 from the drive component 1420 can be seen operationally engaged with a transfer component 1424. The transfer components 1424 is movable with respect to the setback platform 100 and adapted to move components engaged therewith, such as without limitation, shuttle platform 102. Without limitation, as shown in FIGS. 15 and 16, drive component 1420 comprises a motor 1426, a transmission 1428, a work output 1422 in the form of a screw drive, and transfer component 1424 comprising a lead nut operationally engaged with the screw drive of work output 1422. It should be understood that the motor 1426 is adapted to produce shaft work, which is modified by the transmission 1428, to drive the work output 1422 and thereby linearly actuate transfer component 1424. Thus, the transfer component 1424 can be coupled to the shuttle platform 102 and be moveable based on the linkage described above. It should be understood that in the non-limiting embodiment shown the screw drive is translatably fixed with respect to the setback platform 100 and defines an operational axis about which it is free to rotate with respect to the setback platform 102. In other acceptable embodiments drive component 1420 can comprise one or more of a transmission 1428, a rotary actuator, or a linear actuator.

Figure 18:
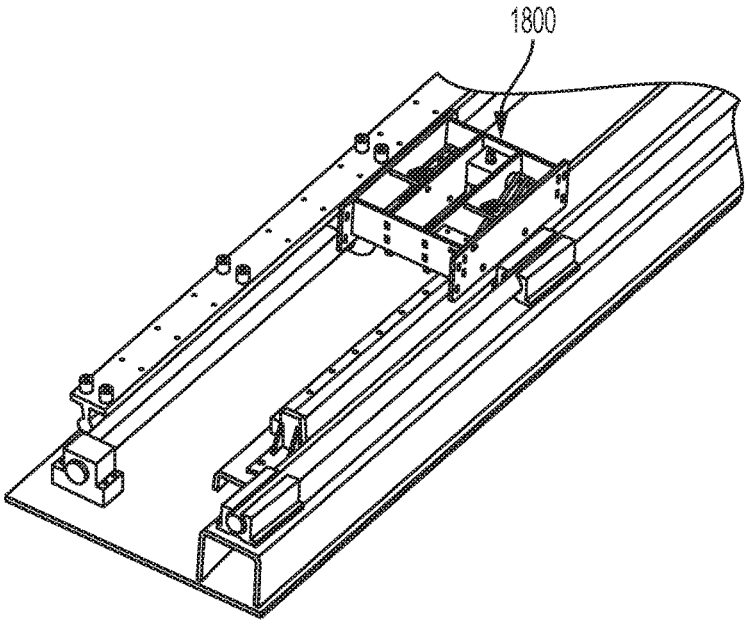
FIG. 18 is an illustration of an embodiment of a connect device for a shuttle platform in accordance with the subject innovation.
Figure 19:
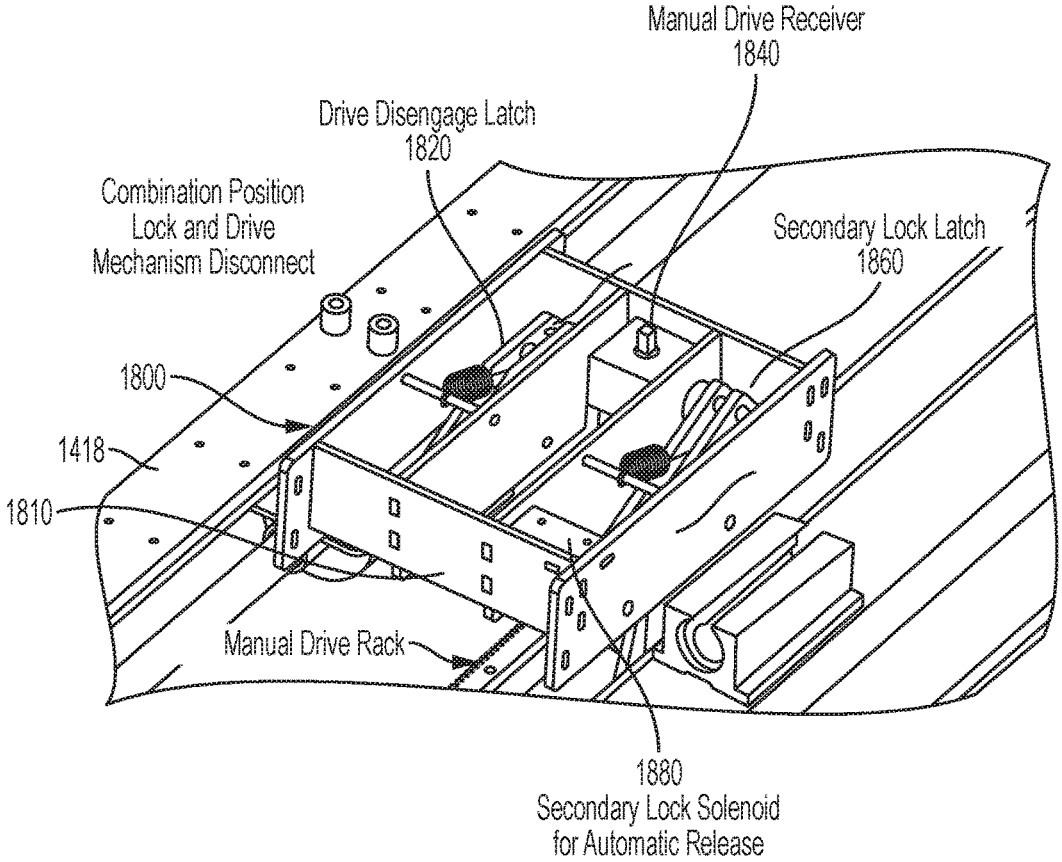
FIG. 19 is an illustration of an embodiment of a connect device for a shuttle platform in accordance with the subject innovation.
Figure 20:
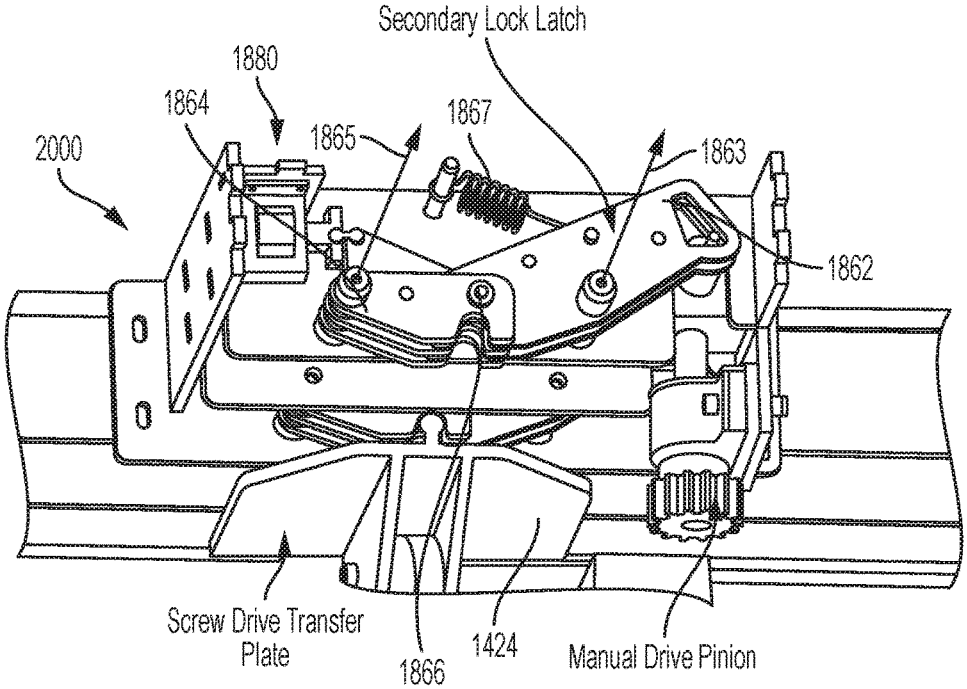
FIG. 20 is an illustration of an embodiment of a connect device for a shuttle platform in accordance with the subject innovation.
Figure 21:
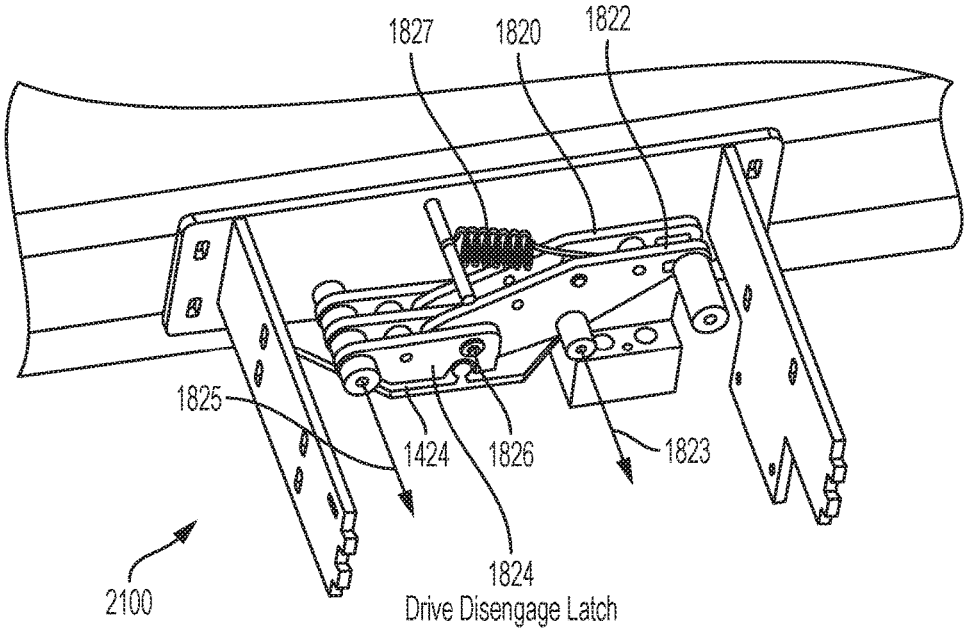
FIG. 21 is an illustration of an embodiment of a connect device for a shuttle platform in accordance with the subject innovation.
Figure 22:
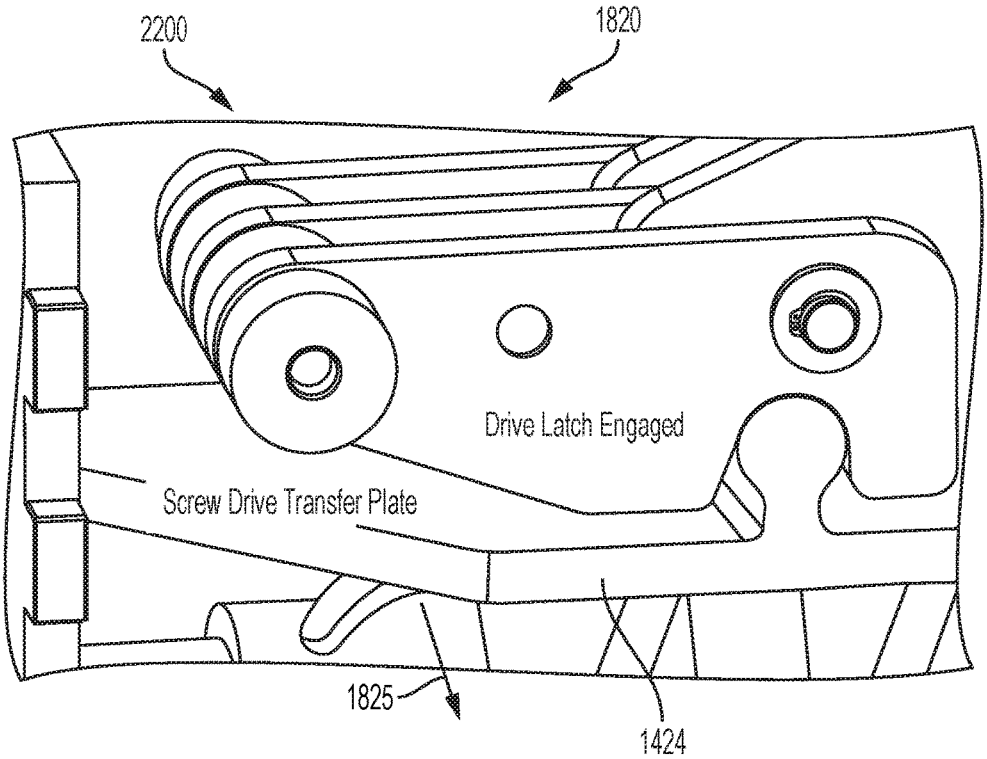
FIG. 22 is an illustration of an embodiment of a connect device for a shuttle platform in accordance with the subject innovation.
Figure 23:
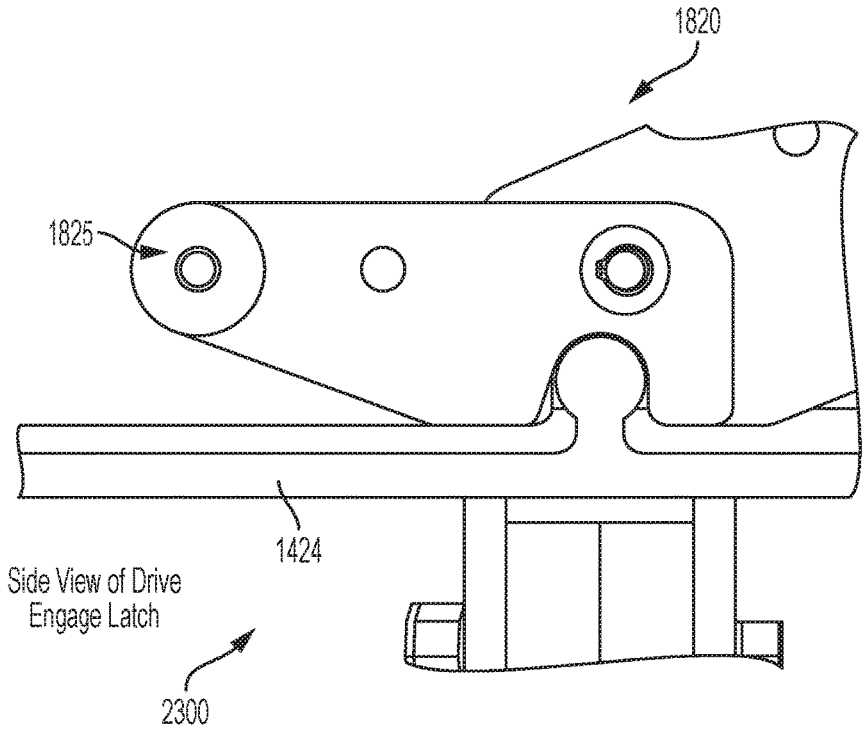
FIG. 23 is an illustration of an embodiment of a connect device for a shuttle platform in accordance with the subject innovation.
Figure 24:
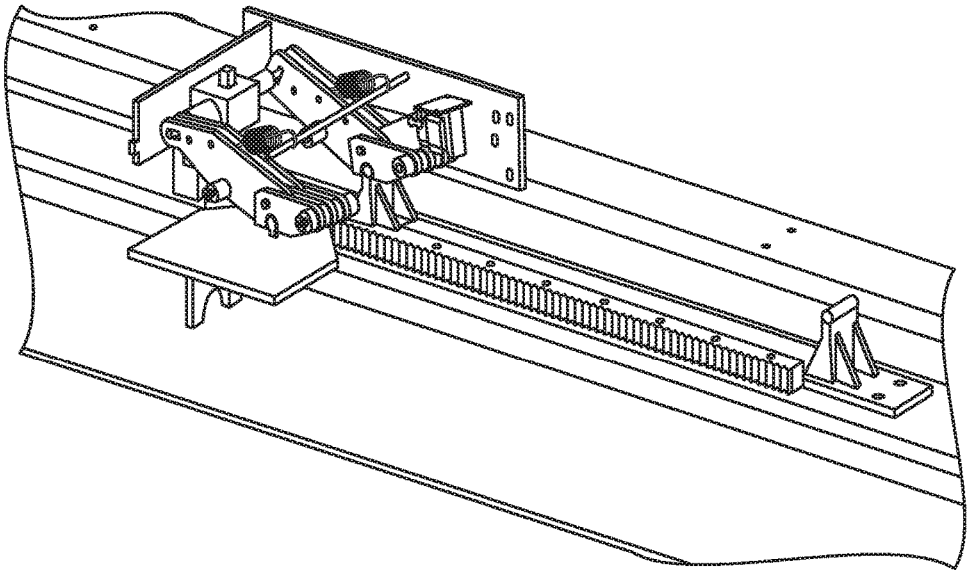
FIG. 24 is an illustration of an embodiment of a connect device for a shuttle platform in accordance with the subject innovation.
Figure 25:
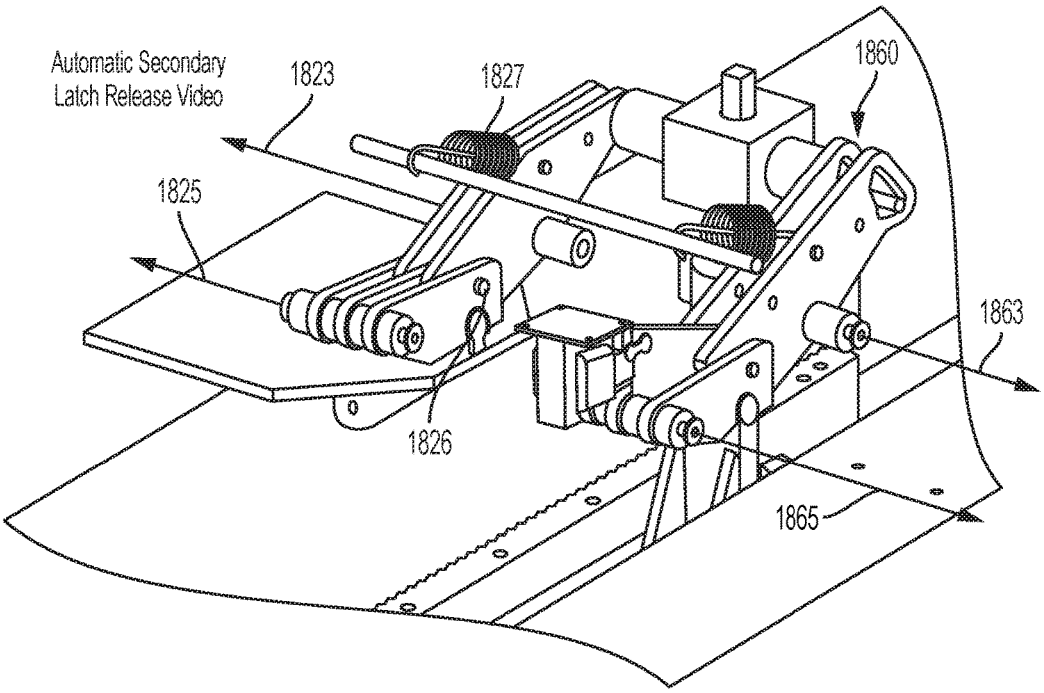
FIG. 25 is an illustration of an embodiment of a connect device for a shuttle platform in accordance with the subject innovation.
Figure 26:
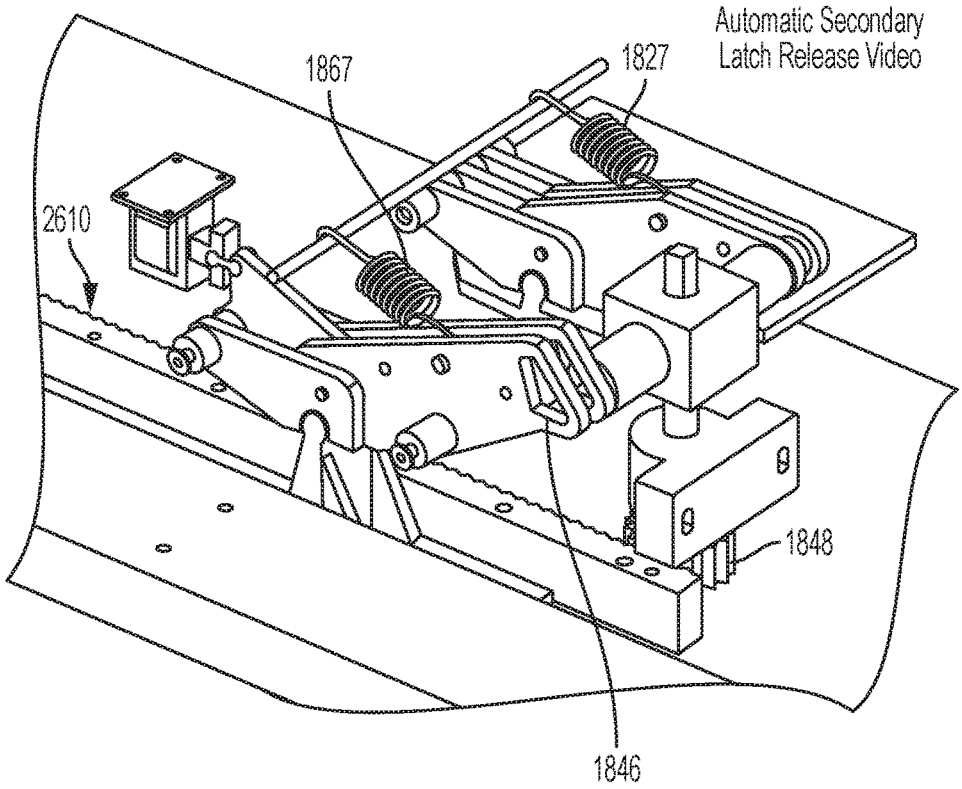
FIG. 26 is an illustration of an embodiment of a connect device for a shuttle platform in accordance with the subject innovation.

FIGS. 18 and 19 show a non-limiting embodiment of a combination position lock and drive mechanism disconnect 1800. The combination position lock and drive mechanism disconnect 1800 is substantially fixedly engaged with the shuttle platform 102 either directly or through other components substantially fixedly engaged with the shuttle platform 102, such as, without limitation, region 1418. The combination position lock and drive mechanism disconnect 1800 comprises a drive disengage latch 1820, a secondary lock latch 1860, a manual drive receiver 1840, and an automatic release 1880. The combination position lock and drive mechanism disconnect 1800 can further comprise a housing 1810.

With reference now to the non-limiting embodiment shown in FIGS. 20-29, the drive disengage latch 1820 is selectably operationally engagable with the transfer component 1424. Operational engagement of the drive disengage latch 1820 is selectably operationally engagable with the transfer component 1424 permits work to be transferred from the transfer component 1424 through the drive disengage latch 1820 and to those components engaged with the drive disengage latch 1820, such as without limitation, the combination position lock and drive mechanism disconnect 1800 and the shuttle platform 102, sufficient to move the shuttle platform 102 between a first position and a second position (discussed above). The drive disengage latch 1820 is selectably operationally engagable with the transfer component 1424 in the sense that it can be engaged with transfer component 1424, such that drive disengage latch 1820, and those components engaged therewith, moves with transfer component 1424 along the guide path, or it can be disengaged from the transfer component 1424, such that drive disengage latch 1820, and those components engaged therewith, can move independently of the transfer component 1424 along the guide path.

In the non-limiting embodiment shown in FIGS. 20-29, drive disengage latch 1820 is a mechanical linkage comprising: a disengage latch input link 1822 rotatably engaged with the combination position lock and drive mechanism disconnect 1800 about pivot axis 1823; a disengage latch output link 1824 rotatably engaged with the combination position lock and drive mechanism disconnect 1800 about pivot axis 1825 and slidably engaged with disengage latch input link 1822 at slidable connection 1826. As shown in the non-limiting embodiment shown in FIGS. 20-29, drive disengage latch 1820 can optionally comprise a biasing component 1827, such as without limitation, a coil spring. As shown in the non-limiting embodiment shown in FIGS. 20-29, biasing component 1827 can be adapted to cause the disengage latch input link 1822 to return to a closed position, consonant with the engaged position, absent the input of other forces. The drive disengage latch 1820 can be opened, for disengagement from the transfer component 1424, or otherwise, by rotating disengage latch input link 1822 about pivot axis 1823. In some embodiments, as will be described more fully herebelow, one way to rotate disengage latch input link 1822 about pivot axis 1823 is by actuating the manual drive receiver 1840. That is, in some embodiments, the drive disengage latch 1820 comprises a mechanical linkage operationally adapted to have its operational engagement with the transfer component 1424 selectably changed by mechanical work transmitted through the manual drive receiver 1840.

Figure 27:
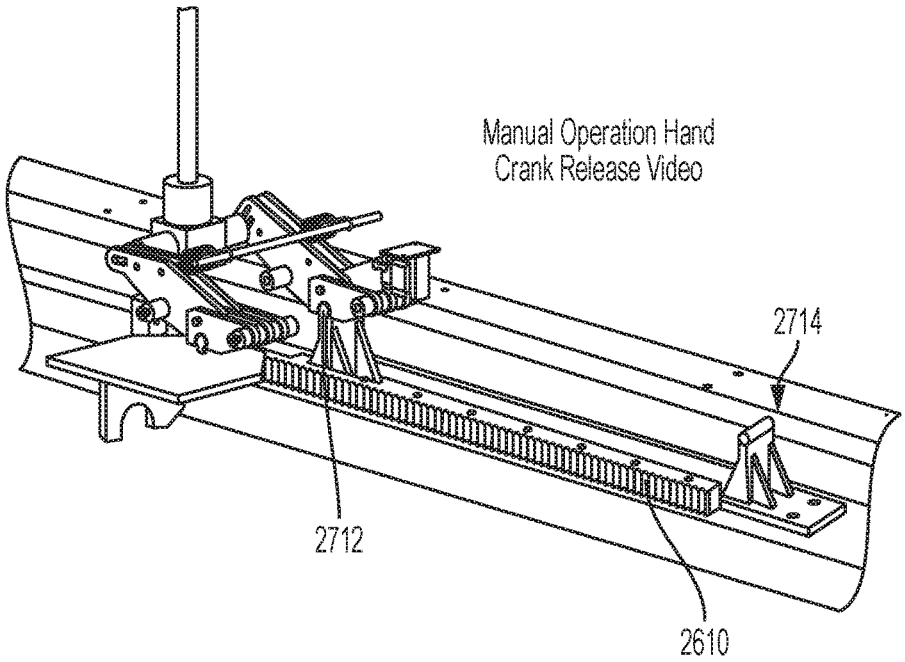
FIG. 27 is an illustration of an embodiment of a connect device for a shuttle platform in accordance with the subject innovation.
Figure 28:
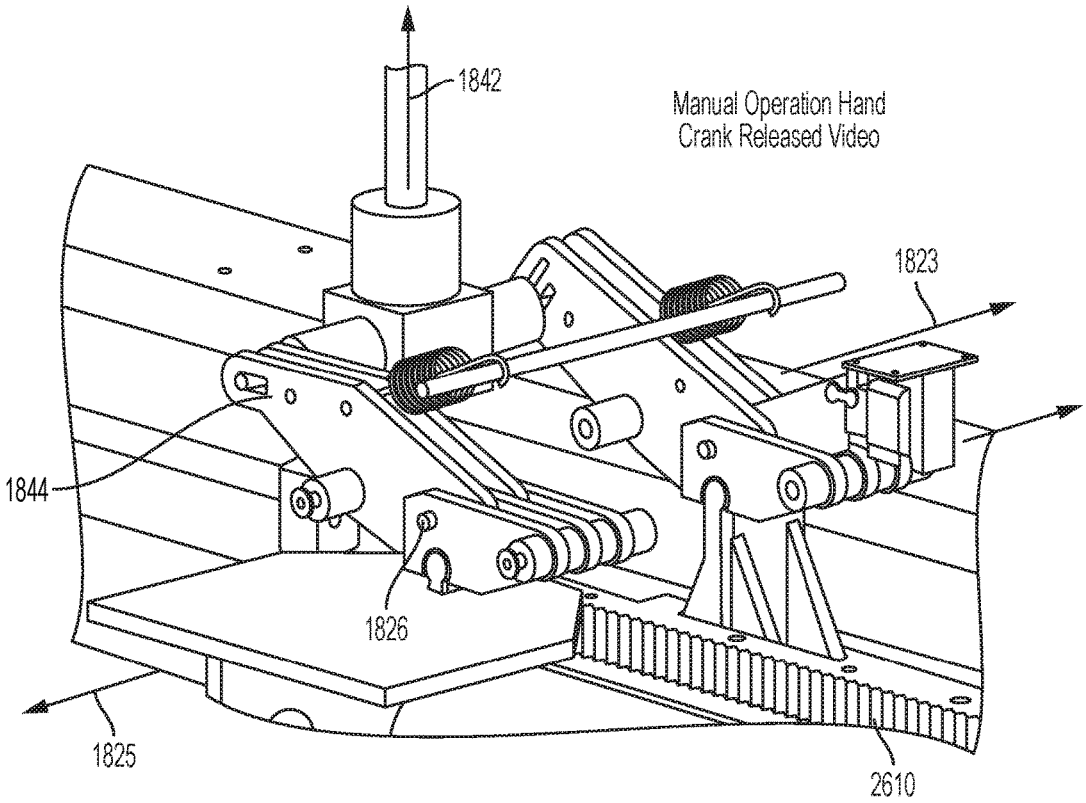
FIG. 28 is an illustration of an embodiment of a connect device for a shuttle platform in accordance with the subject innovation.
Figure 29:
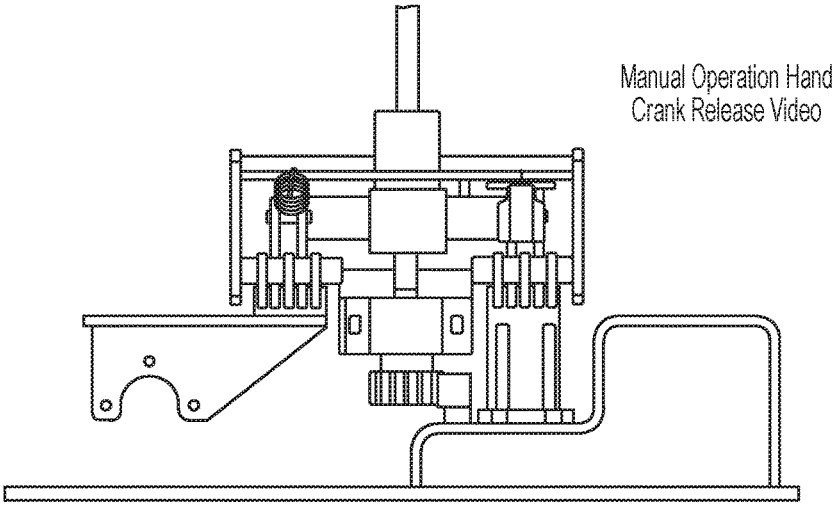
FIG. 29 is an illustration of an embodiment of a connect device for a shuttle platform in accordance with the subject innovation.

With continued reference to the non-limiting embodiment shown in FIGS. 20-29, the secondary lock latch 1860 is selectably alternatively engagable between the first striker 2712 and the second striker 2714. Both the first striker 2712 and the second striker 2714 are substantially fixedly engaged with the setback platform 100. The first striker 2712 is distal from the centerline while the second striker 2714 is proximate to the centerline. Engagement of the secondary lock latch 1860 with either the first striker 2712 or the second striker 2714 substantially fixes the position of the shuttle platform 102 with respect to the setback platform 100. Accordingly engagement of the secondary lock latch 1860 with either the first striker 2712 or the second striker 2714 can act as a brake or stopping mechanism. The secondary lock latch 1860 is selectably alternatively engagable between the first striker 2712 and the second striker 2714 in the sense that it can be engaged with the first striker 2712, such that secondary lock latch 1860, and those components engaged therewith, are substantially fixed in a first place along the guide path, or it can be disengaged from the first striker 2712 and the second striker 2714, such that secondary lock latch 1860, and those components engaged therewith, can move along the guide path, or it can be engaged with the second striker 2714, such that secondary lock latch 1860, and those components engaged therewith, are substantially fixed in a second place along the guide path. It is to be appreciated that, although FIG. 27 illustrates two (2) strikers, there can be M number of strikers where M is a positive integer.

In the non-limiting embodiment shown in FIGS. 20-29, secondary lock latch 1860 is a mechanical linkage comprising: a lock latch input link 1862 rotatably engaged with the combination position lock and drive mechanism disconnect 1800 about pivot axis 1863; a lock latch output link 1864 rotatably engaged with the combination position lock and drive mechanism disconnect 1800 about pivot axis 1865 and slidably engaged with lock latch input link 1862 at slidable connection 1866. As shown in the non-limiting embodiment shown in FIGS. 20-29, secondary lock latch 1860 can optionally comprise a biasing component 1867, such as without limitation, a coil spring. As shown in the non-limiting embodiment shown in FIGS. 20-29, biasing component 1867 can be adapted to cause the lock latch input link 1862 to return to a closed position, consonant with an engaged position, absent the input of other forces. The secondary lock latch 1860 can be opened, for disengagement from the first striker 2712, or the second striker 2714, or otherwise, by rotating lock latch input link 1862 about pivot axis 1863.

In some embodiments, as will be described more fully herebelow, one way to rotate lock latch input link 1862 about pivot axis 1863 is by actuating the manual drive receiver 1840. The secondary lock latch 1860 can be opened, for disengagement from the first striker 2712, or the second striker 2714, or otherwise, by rotating lock latch output link 1864 about pivot axis 1865. In some embodiments, as will be described more fully herebelow, one way to rotate lock latch output link 1864 about pivot axis 1865 is by actuating the automatic release 1880. That is, in some embodiments, the secondary lock latch 1860 comprises a mechanical linkage operationally adapted to have its operational engagement with both the first striker 2712 and the second striker 2714 selectably changed by mechanical work transmitted through either the manual drive receiver 1840 or through the automatic release 1880.

With continued reference to the non-limiting embodiment shown in FIGS. 20-29, the manual drive receiver 1840 is simultaneously operationally engagable with both the drive disengage latch 1820 and the secondary lock latch 1860. The manual drive receiver 1840 comprises a set of manual drive engagement features 1844, 1846 adapted to mechanically engage the disengage latch input link 1822, and the lock latch input link 1862, respectively. In the non-limiting embodiment shown in FIGS. 20-29, the manual drive engagement features 1844, 1846 are each a pin slidably engaged with a corresponding slot in the disengage latch input link 1822, or the lock latch input link 1862. These features are non-limiting in the sense that a mechanical connection chosen with good engineering judgment can be utilized such that actuation of the manual drive receiver 1840 by translation along axis 1842 results in simultaneous operational rotation of both of the disengage latch input link 1822, and the lock latch input link 1862 sufficient to simultaneously disengage drive disengage latch 1820 and secondary lock latch 1860. The manual drive receiver 1840 further comprises a manual drive work output 1848 operationally engagable with the manual drive work input 2610 that is substantially fixed with respect to setback platform 100.

Figure 31:
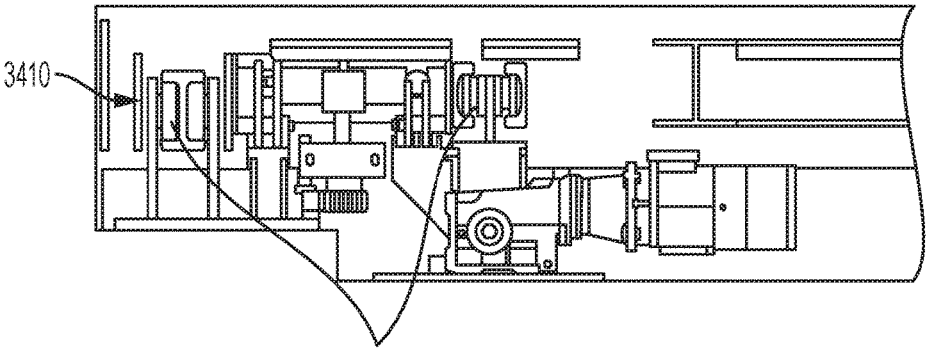
FIG. 31 is an illustration of a drive system in accordance with the subject innovation.

In the non-limiting embodiment shown in FIGS. 20-29, the manual drive work output 1848 is a pinion and the manual drive work input 2610 is a compatible rack operationally engaged with the pinion, the rack and pinion form an engaged set operable by rotating the manual drive receiver 1840 about axis 1842. These features are non-limiting in the sense that, as selected with good engineering judgment, any manual drive work output 1848 adapted to transmit work from the manual drive receiver 1840 to the manual drive work input 2610 to produce a motive load on the shuttle platform 102 sufficient to move the a shuttle platform 102 between the first position and the second position is acceptable. With continued reference to the non-limiting embodiment shown in FIGS. 20-29, the automatic release 1880 is adapted to selectably alternatively engage the secondary lock latch with the first striker 2712, and selectably alternatively engage the secondary lock latch with the second striker 2714. The automatic release 1880 is adapted to rotate lock latch output link 1864 about pivot axis 1865 and thereby to open the secondary lock latch 1860 such that the secondary lock latch 1860 is not engaged with either the first striker 2712, or the second striker 2714, or otherwise. Releasing the automatic release 1880 permits the secondary lock latch 1860 to close and return to a position consonant with engagement with either the first striker 2712, or the second striker 2714. In the non-limiting embodiment shown in FIGS. 20-29, the automatic release 1880 is a solenoid but any component selected with good engineering judgment capable of performing the requisite actuation is acceptable Furthermore, referring now FIGS. 14, 17 and 31, it is to be understood that the embodiments shown of the tracking components 1310 are non-limiting, in the sense that tracking components 1310 may comprise the guide and slide bearing system as in FIGS. 14 and 17, the wheel and track system 3410 or roller and track system shown in FIG. 31, any of the above listed straight line mechanisms and quasi-straight line mechanisms, or other tracking component 1310 chosen with good engineering judgment.

Figure 32:
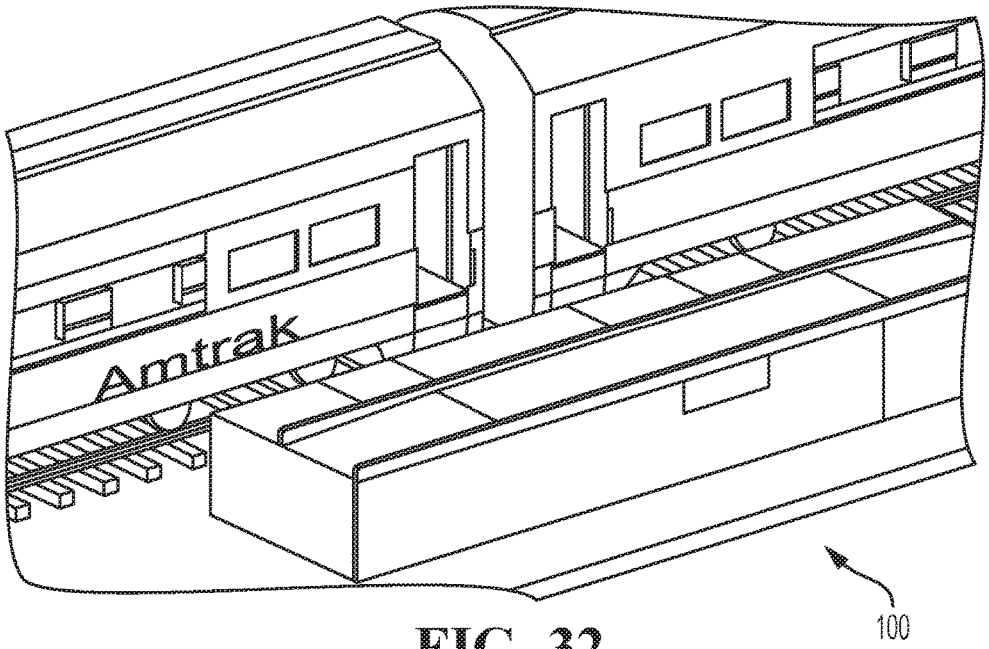
FIG. 32 is an illustration of a setback platform in accordance with the subject innovation.
Figure 33:
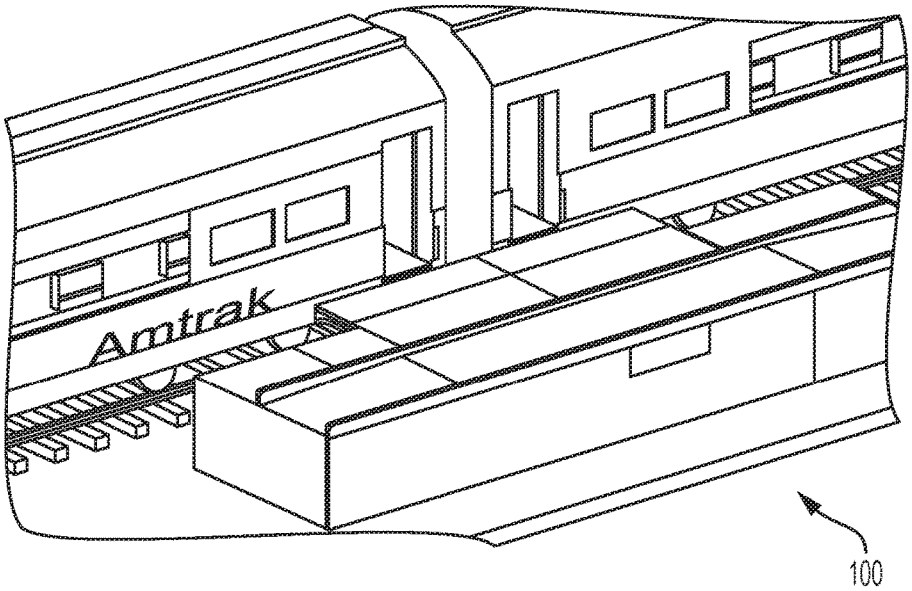
FIG. 33 is an illustration of a setback platform in accordance with the subject innovation.
Figure 34:
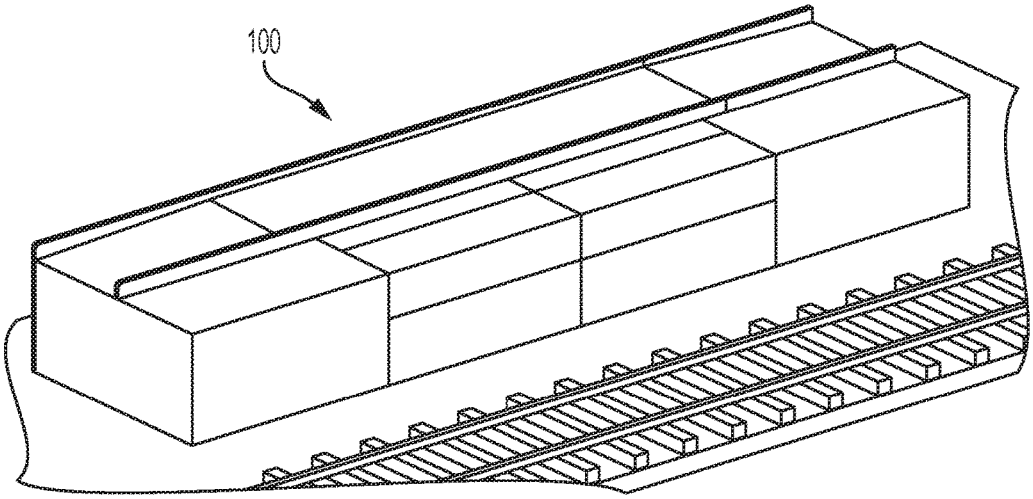
FIG. 34 is an illustration of a setback platform in accordance with the subject innovation.
Figure 35:
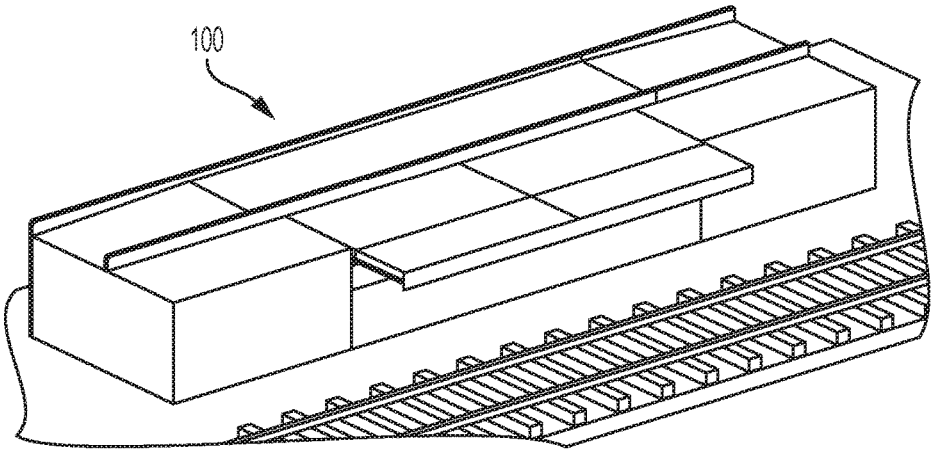
FIG. 35 is an illustration of a setback platform in accordance with the subject innovation.
Figure 37:
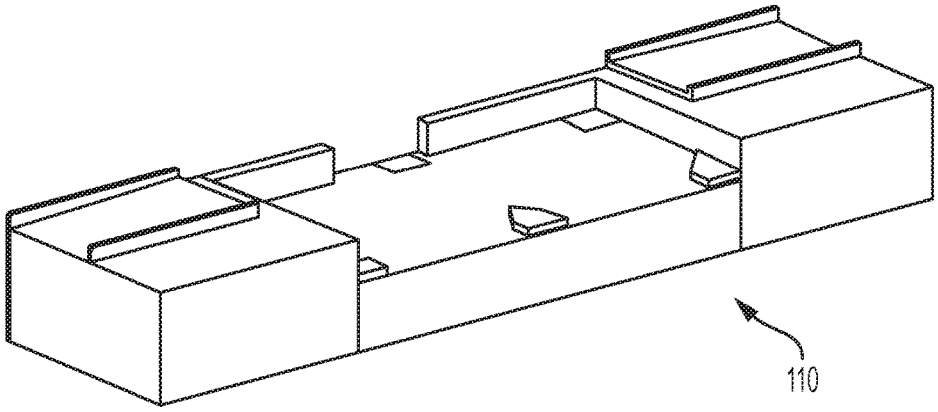
FIG. 37 is an illustration of a setback platform in accordance with the subject innovation.
Figure 38:
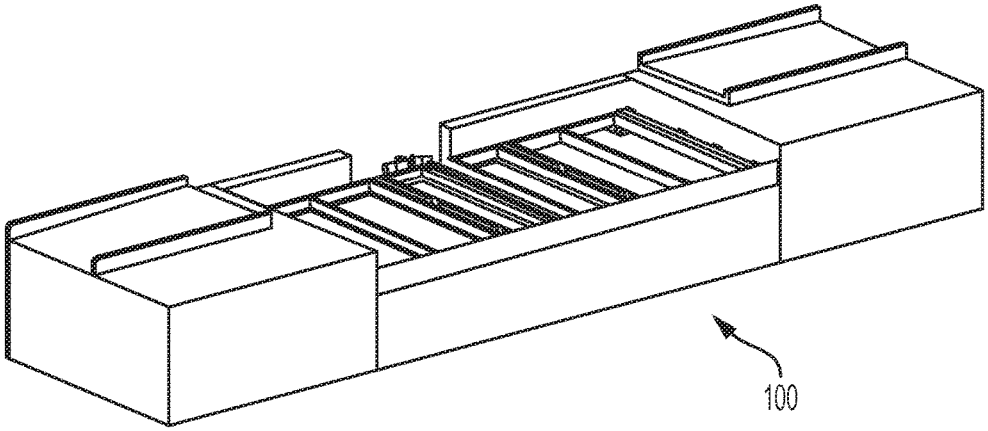
FIG. 38 is an illustration of a setback platform in accordance with the subject innovation.
Figure 39:
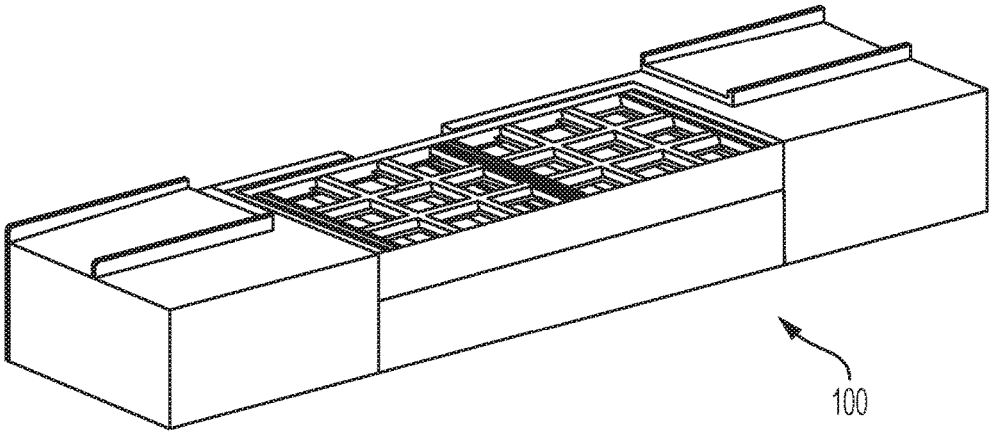
FIG. 39 is an illustration of a setback platform in accordance with the subject innovation.
Figure 40:
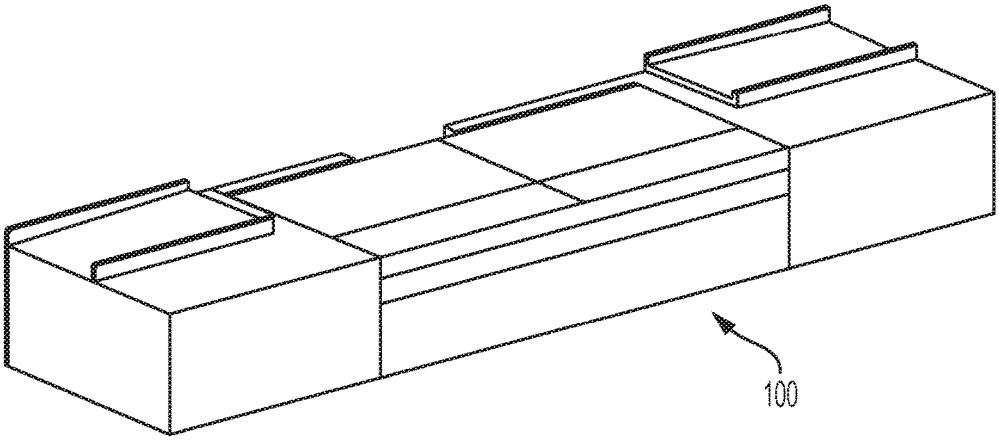
FIG. 40 is an illustration of a setback platform in accordance with the subject innovation.
Figure 41:
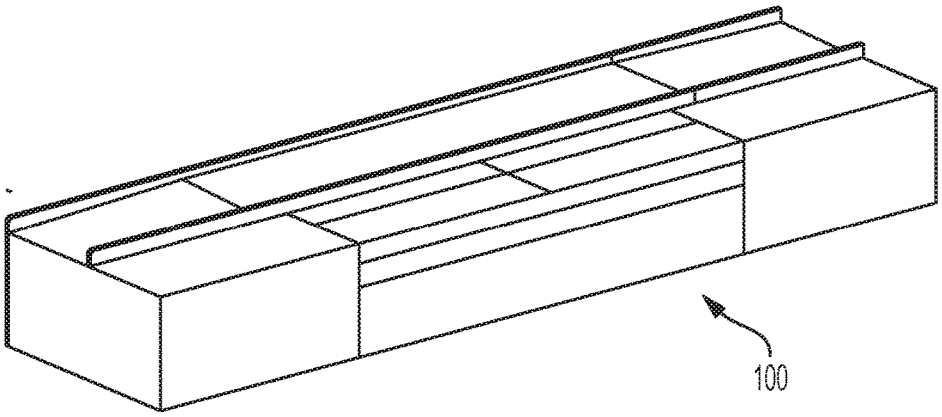
FIG. 41 is an illustration of a setback platform in accordance with the subject innovation.

Specifically, FIG. 32 and FIG. 34 illustrate the shuttle table embodiment in a retracted position. Similarly, FIGS. 33 and 35 illustrate the shuttle table embodiment in deployed position. FIG. 36 illustrates the shuttle table assembly in a exploded view. FIG. 37 illustrates the platform structure for accommodating the shuttle table assembly and FIG. 38 and FIG. 39 illustrate the shuttle table assembly installed on said platform structure. Finally, FIG. 40 illustrate the shuttle table assembly constructed and FIG. 41 illustrates the shuttle table assembly completed with a separate pedestrian walkway or catwalk.

Figure 42:
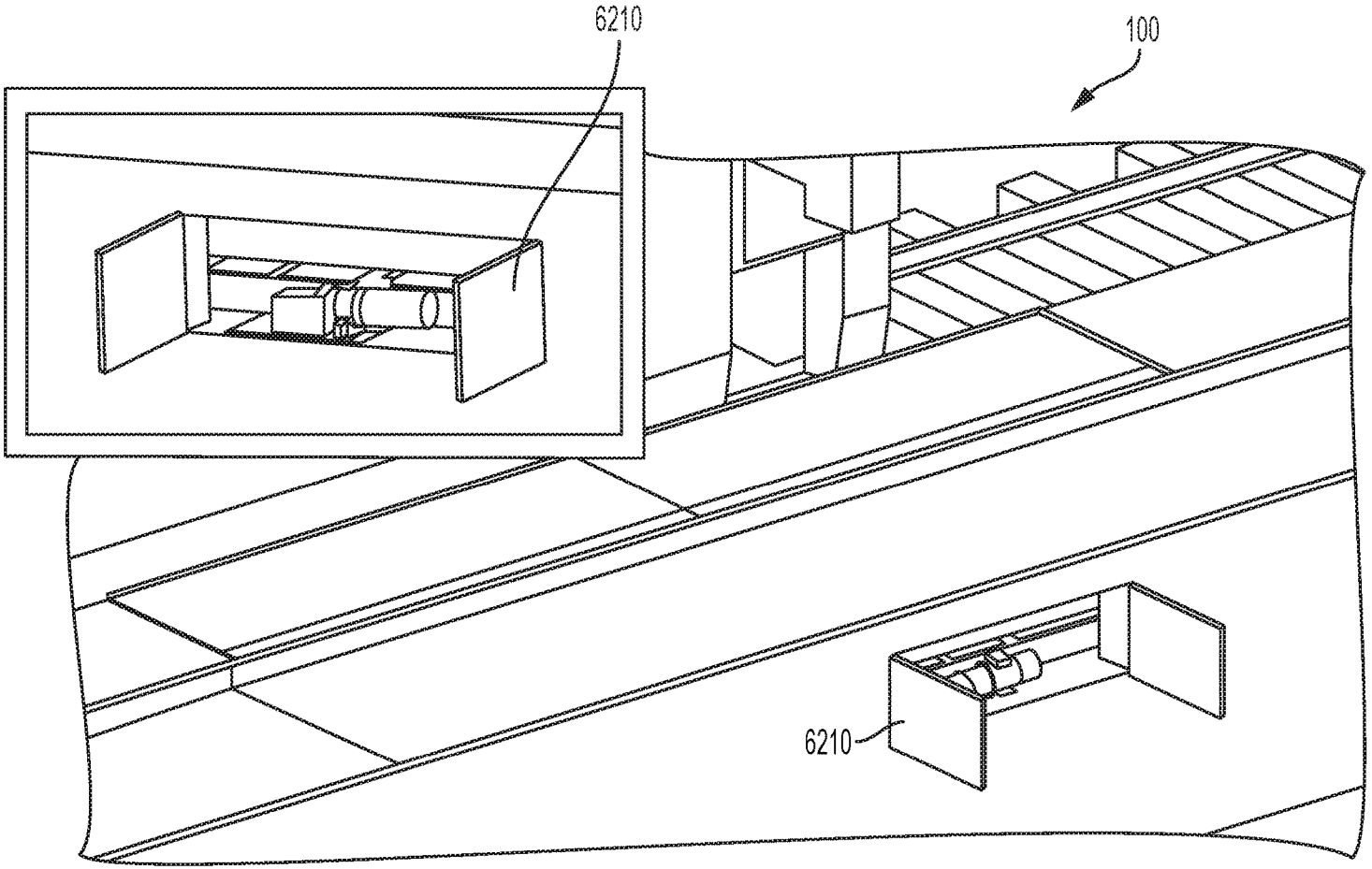
FIG. 42 is an illustration of a setback platform in accordance with the subject innovation.

It is contemplated drive system with a drive system access is included as illustrated in FIG. 42. It is contemplated drive system 1400 with a drive system access 6210 is included as illustrated in FIG. 42. The drive system access 6210 may be a door, hatchway, tube, port or other access adapted for permitting selectable access to the drive system 1400 for repair, maintenance, cleaning, or other service. The drive system access 6210 may be selectably closable such that it may be opened to permit service or closed to prevent or reduce intrusion of water, intrusion of debris, tampering, or vandalism.

The aforementioned systems (e.g., the shuttle platform 102, the controller component 120, etc.), architectures, environments, and the like have been described with respect to interaction between several components and/or elements. It should be appreciated that such components, devices, and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein for the sake of brevity, but known by those of skill in the art.

In an embodiment, a support structure is provided that is incorporated into the setback platform and affixed to the ground level to provide structural support to the shuttle platform. In an embodiment, a guide system is provided that is coupled to the shuttle platform for the linear movement. In an embodiment, a drive component is provided that is configured to actuate the shuttle platform. In an embodiment, a motion sensor is provided that is configured to detect a movement in an area between the front edge and the centerline, wherein the drive component is disabled based on a detection of the movement. In the embodiment, a remote signal communicated from the light rail transit vehicle to activate the linear movement of the shuttle platform from at least one of the first position to the second position or the second position to the first position. In an embodiment, a solenoid device is provided that controls a physical connection between a bottom portion of the shuttle platform and a guide system that is actuated in the linear movement with a screw drive. In an embodiment, a disconnect device that disconnects the physical connection between a bottom portion of the shuttle platform and the guide system to prevent the screw drive from providing the linear movement, wherein the disconnect device connects a gear mechanism that is configured to provide linear movement rather than the screw drive. In an embodiment, a power source is provided that delivers electrical power to provide at least the linear movement. In an embodiment, a controller component is provided that controls the shuttle platform, and, in particular, at least the motion from the first position to the second position. In an embodiment, an audible alert is activated during the linear movement from at least one of the first to the second position or the second position to the first position. In an embodiment, a railing is affixed to at least one of the first path or the shuttle platform. In an embodiment, a visible alert that is activated during the linear movement from at least one of the first to the second position or the second position to the first position. In an embodiment, a controller component is provided that locks a physical barrier affixed to a surface of the shuttle platform while the shuttle platform is in the first position and unlocks the physical barrier while the shuttle platform is in the second position.

Figure 43:
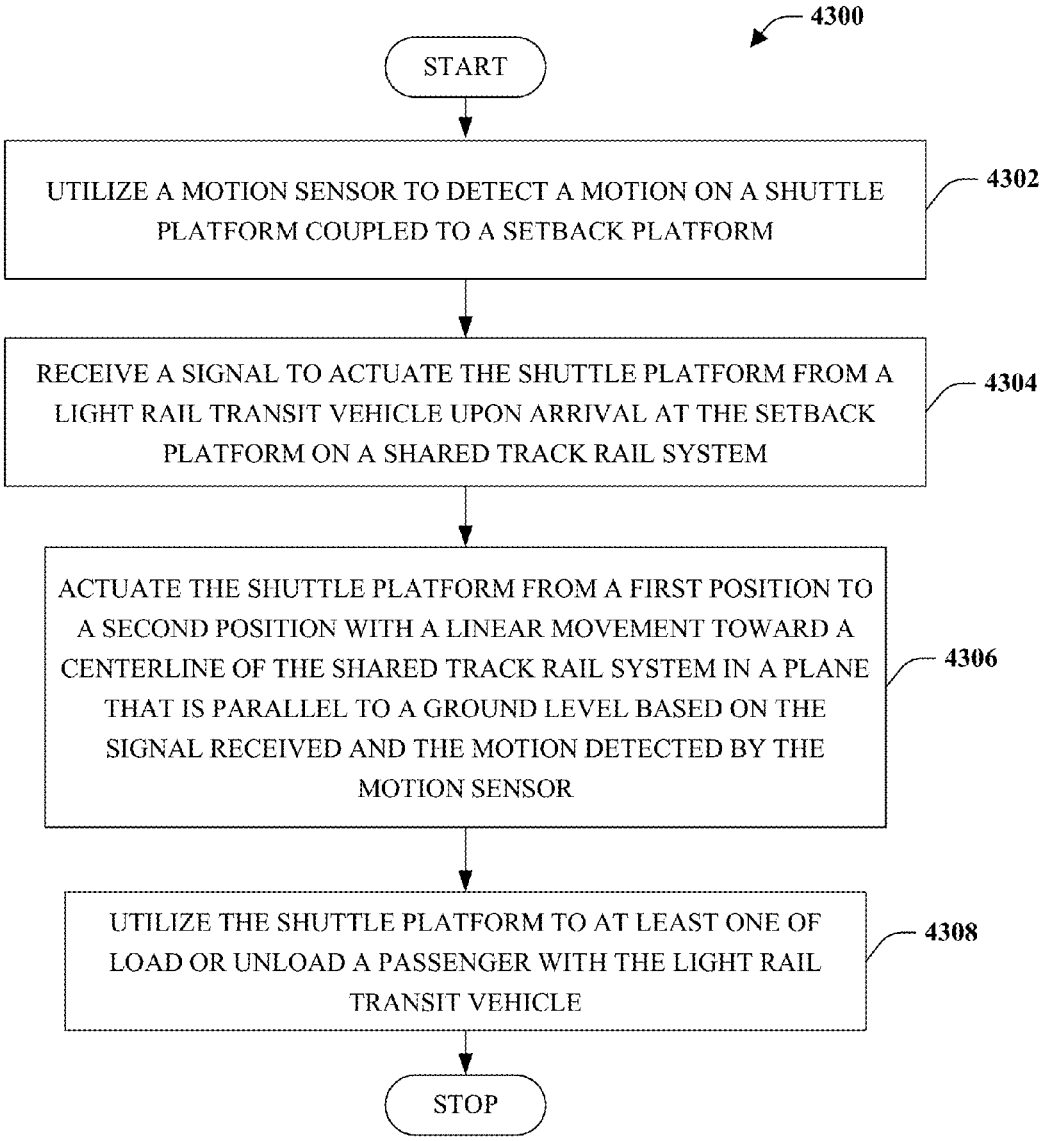
FIG. 43 illustrates a flow chart of a method for actuating a shuttle platform from a first position to a second position.
Figure 44:
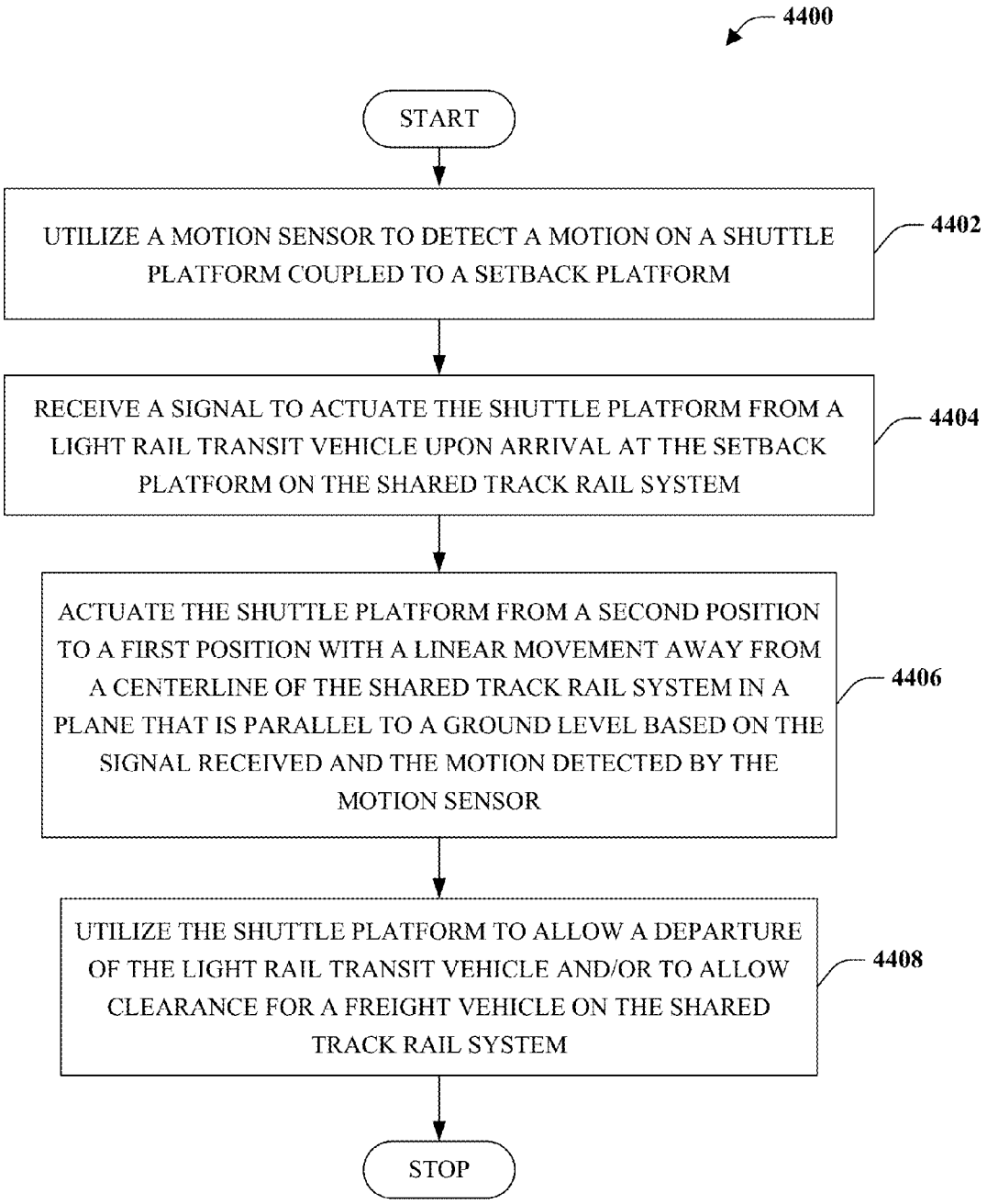
FIG. 44 illustrates a flow chart of a method for actuating a shuttle platform from a second position to a first position.

In view of the exemplary devices and elements described supra, methodologies that may be implemented in accordance with the disclosed subject matter will be better appreciated with reference to the flow charts of FIGS. 43 and 44. The methodologies are shown and described as a series of blocks, the claimed subject matter is not limited by the order of the blocks, as some blocks may occur in different orders and/or concurrently with other blocks from what is depicted and described herein. Moreover, not all illustrated blocks may be required to implement the methods described hereinafter. The methodologies can be implemented by a component or a portion of a component that includes at least a processor, a memory, and an instruction stored on the memory for the processor to execute. For instance, a controller component as described herein can implement one or more of the methodologies.

FIG. 43 illustrates a method 4300 for actuating a shuttle platform from a first position to a second position in a linear motion in order to load and/or unload passengers from a light rail transit vehicle on a shared track. At reference numeral 4302, a motion sensor can be utilized to detect a motion on a shuttle platform or in an area proximate to the shuttle platform, wherein the shuttle platform is coupled to a setback platform. At reference numeral 4304, a signal to actuate the shuttle platform can be received from the light rail transit vehicle upon arrival at the setback platform on the shared track rail system. At reference numeral 4306, the shuttle platform can be actuated from a first position to a second position with a linear movement toward a centerline of the shared track rail system in a plane that is parallel to a ground level, wherein the linear movement is based upon the signal received and the motion detected by the motion sensor. At reference numeral 4308, the shuttle platform can be utilized to load and/or unload a passenger with the light rail transit vehicle.

FIG. 44 illustrates a method 4400 for actuating a shuttle platform from a second position to a first position in a linear motion in order provide clearance for a freight vehicle on a shared track and/or to allow a light rail transit vehicle to depart from a setback platform. At reference numeral 4402, a motion sensor can be utilized to detect a motion on a shuttle platform or in an area proximate to the shuttle platform, wherein the shuttle platform is coupled to a setback platform. At reference numeral 4404, a signal to actuate the shuttle platform can be received from the light rail transit vehicle upon arrival at the setback platform on the shared track rail system. At reference numeral 4406, the shuttle platform can be actuated from a second position to a first position with a linear movement away from a centerline of the shared track rail system in a plane that is parallel to a ground level, wherein the linear movement is based upon the signal received and the motion detected by the motion sensor. At reference numeral 4408, the shuttle platform can be moved to the first position to allow a departure of a light rail transit vehicle and/or to allow a clearance for a freight vehicle on the shared track rail system.

In an aspect, incorporated is an APPENDIX A (attached). APPENDIX A is a document that describes aspects of the claimed subject matter, and this Appendix forms part of this specification.

As used herein, the terms "component" and "system," as well as forms thereof may intend to refer to a computer-related entity, either hardware, a combination of hardware and software, software, or software in execution. For example, a component may be, but is not limited to being, a process running on a processor, a processor, an object, an instance, an executable, a thread of execution, a program, and/or a computer. By way of illustration, both an application running on a computer and the computer can be a component. One or more components may reside within a process and/or thread of execution and a component may be localized on one computer and/or distributed between two or more computers.

The word "exemplary" or various forms thereof are used herein to mean serving as an example, instance, or illustration. Any aspect or design described herein as "exemplary" is not necessarily to be construed as preferred or advantageous over other aspects or designs. Furthermore, examples are provided solely for purposes of clarity and understanding and are not meant to limit or restrict the claimed subject matter or relevant portions of this disclosure in any manner. It is to be appreciated a myriad of additional or alternate examples of varying scope could have been presented, but have been omitted for purposes of brevity.

Furthermore, to the extent that the terms "includes," "contains," "has," "having" or variations in form thereof are used in either the detailed description or the claims, such terms are intended to be inclusive in a manner similar to the term "comprising" as "comprising" is interpreted when employed as a transitional word in a claim.

Figure 45:
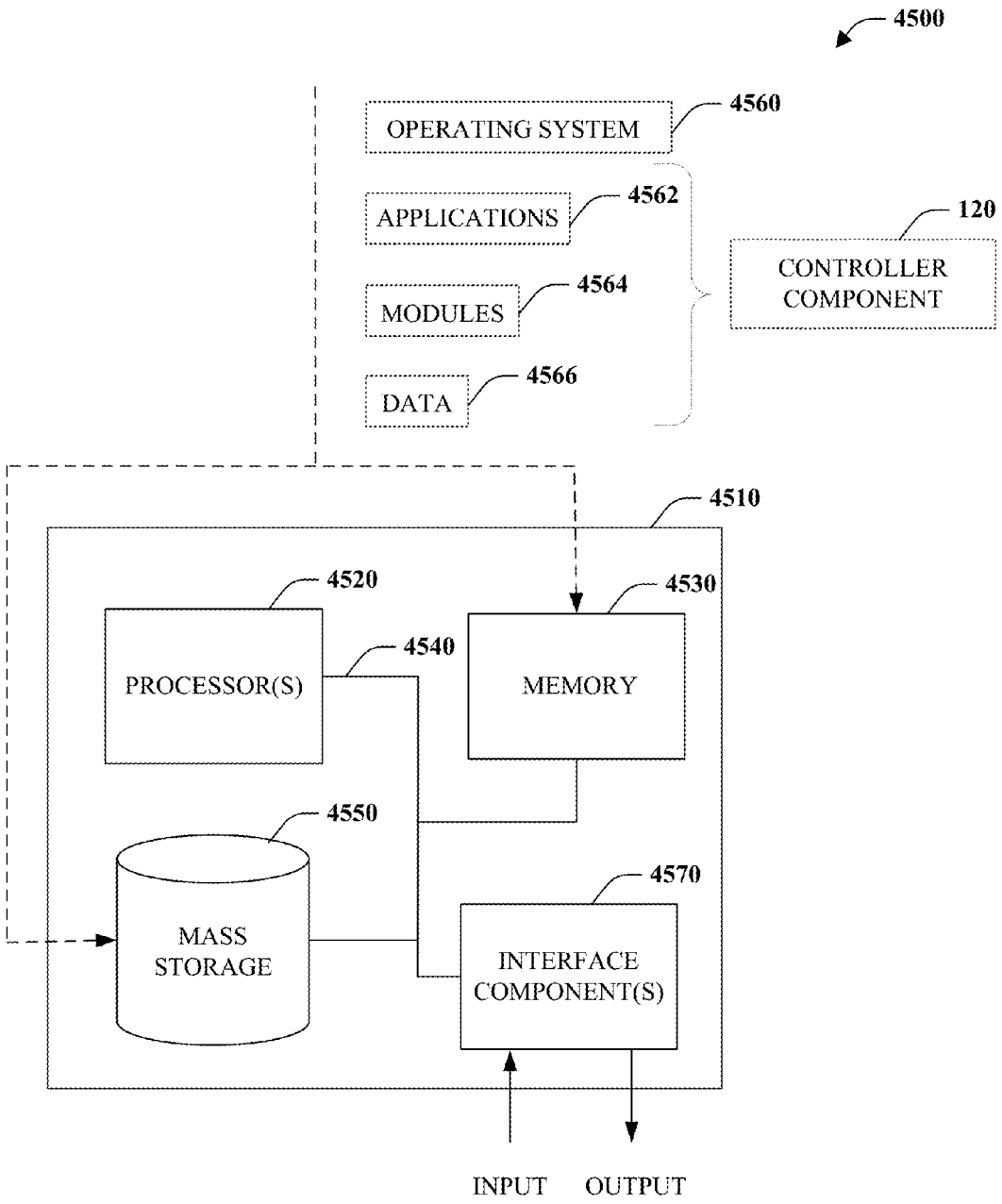
FIG. 45 is a schematic block diagram illustrating a suitable operating environment for aspects of the subject disclosure; and APPENDIX A is a document that describes aspects of the claimed subject matter, and this Appendix forms part of this specification.

In order to provide a context for the claimed subject matter, FIG. 45 as well as the following discussion are intended to provide a brief, general description of a suitable environment in which various aspects of the subject matter can be implemented. The suitable environment, however, is only an example and is not intended to suggest any limitation as to scope of use or functionality.

While the above disclosed system and methods can be described in the general context of computer-executable instructions of a program that runs on one or more computers, those skilled in the art will recognize that aspects can also be implemented in combination with other program modules or the like. Generally, program modules include routines, programs, components, data structures, among other things that perform particular tasks and/or implement particular abstract data types. Moreover, those skilled in the art will appreciate that the above systems and methods can be practiced with various computer system configurations, including single-processor, multi-processor or multi-core processor computer systems, mini-computing devices, mainframe computers, as well as personal computers, hand-held computing devices (e.g., personal digital assistant (PDA), portable gaming device, smartphone, tablet, Wi-Fi device, laptop, phone, among others), microprocessor-based or programmable consumer or industrial electronics, and the like. Aspects can also be practiced in distributed computing environments where tasks are performed by remote processing devices that are linked through a communications network. However, some, if not all aspects of the claimed subject matter can be practiced on stand-alone computers. In a distributed computing environment, program modules may be located in one or both of local and remote memory storage devices.

With reference to FIG. 45, illustrated at 4500 is an example general-purpose computer 4510 or computing device (e.g., desktop, laptop, server, hand-held, programmable consumer or industrial electronics, set-top box, game system . . . ). The computer 4510 includes one or more processor(s) 4520, memory 4530, system bus 4540, mass storage 4550, and one or more interface components 4570. The system bus 4540 communicatively couples at least the above system components. However, it is to be appreciated that in its simplest form the computer 4510 can include one or more processors 4520 coupled to memory 4530 that execute various computer executable actions, instructions, and or components stored in memory 4530.

The processor(s) 4520 can be implemented with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any processor, controller, microcontroller, or state machine. The processor(s) 4520 may also be implemented as a combination of computing devices, for example a combination of a DSP and a microprocessor, a plurality of microprocessors, multi-core processors, one or more microprocessors in conjunction with a DSP core, or any other such configuration.

The computer 4510 can include or otherwise interact with a variety of computer-readable media to facilitate control of the computer 4510 to implement one or more aspects of the claimed subject matter. The computer-readable media can be any available media that can be accessed by the computer 4510 and includes volatile and nonvolatile media, and removable and non-removable media. By way of example, and not limitation, computer-readable media may comprise computer storage media and communication media.

Computer storage media includes volatile and nonvolatile, removable and non-removable media implemented in any method or technology for storage of information such as computer-readable instructions, data structures, program modules, or other data. Computer storage media includes, but is not limited to memory devices (e.g., random access memory (RAM), read-only memory (ROM), electrically erasable programmable read-only memory (EEPROM) . . . ), magnetic storage devices (e.g., hard disk, floppy disk, cassettes, tape . . . ), optical disks (e.g., compact disk (CD), digital versatile disk (DVD) . . . ), and solid state devices (e.g., solid state drive (SSD), flash memory drive (e.g., card, stick, key drive . . . ) . . . ), or any other medium which can be used to store the desired information and which can be accessed by the computer 4510.

Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 4530 and mass storage 4550 are examples of computer-readable storage media. Depending on the exact configuration and type of computing device, memory 4530 may be volatile (e.g., RAM), non-volatile (e.g., ROM, flash memory . . . ) or some combination of the two. By way of example, the basic input/output system (BIOS), including basic routines to transfer information between elements within the computer 4510, such as during start-up, can be stored in nonvolatile memory, while volatile memory can act as external cache memory to facilitate processing by the processor(s) 4520, among other things.

Mass storage 4550 includes removable/non-removable, volatile/non-volatile computer storage media for storage of large amounts of data relative to the memory 4530. For example, mass storage 4550 includes, but is not limited to, one or more devices such as a magnetic or optical disk drive, floppy disk drive, flash memory, solid-state drive, or memory stick.

Memory 4530 and mass storage 4550 can include, or have stored therein, operating system 4560, one or more applications 4562, one or more program modules 4564, and data 4566. The operating system 4560 acts to control and allocate resources of the computer 4510. Applications 4562 include one or both of system and application software and can exploit management of resources by the operating system 4560 through program modules 4564 and data 4566 stored in memory 4530 and/or mass storage 4550 to perform one or more actions. Accordingly, applications 4562 can turn a general-purpose computer 4510 into a specialized machine in accordance with the logic provided thereby.

All or portions of the claimed subject matter can be implemented using standard programming and/or engineering techniques to produce software, firmware, hardware, or any combination thereof to control a computer to realize the disclosed functionality. By way of example and not limitation, the controller component 120, or portions thereof, can be, or form part, of an application 4562, and include one or more modules 4564 and data 4566 stored in memory and/or mass storage 4550 whose functionality can be realized when executed by one or more processor(s) 4520.

In accordance with one particular embodiment, the processor(s) 4520 can correspond to a system on a chip (SOC) or like architecture including, or in other words integrating, both hardware and software on a single integrated circuit substrate. Here, the processor(s) 4520 can include one or more processors as well as memory at least similar to processor(s) 4520 and memory 4530, among other things. Conventional processors include a minimal amount of hardware and software and rely extensively on external hardware and software. By contrast, an SOC implementation of processor is more powerful, as it embeds hardware and software therein that enable particular functionality with minimal or no reliance on external hardware and software. For example, the controller component 120, and/or associated functionality can be embedded within hardware in a SOC architecture.

The computer 4510 also includes one or more interface components 4570 that are communicatively coupled to the system bus 4540 and facilitate interaction with the computer 4510. By way of example, the interface component 4570 can be a port (e.g., serial, parallel, PCMCIA, USB, FireWire . . . ) or an interface card (e.g., sound, video . . . ) or the like. In one example implementation, the interface component 4570 can be embodied as a user input/output interface to enable a user to enter commands and information into the computer 4510 through one or more input devices (e.g., pointing device such as a mouse, trackball, stylus, touch pad, keyboard, microphone, joystick, game pad, satellite dish, scanner, camera, other computer . . . ). In another example implementation, the interface component 4570 can be embodied as an output peripheral interface to supply output to displays (e.g., CRT, LCD, plasma . . . ), speakers, printers, and/or other computers, among other things. Still further yet, the interface component 4570 can be embodied as a network interface to enable communication with other computing devices (not shown), such as over a wired or wireless communications link.

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components. Any components described herein may also interact with one or more other components not specifically described herein but generally known by those of skill in the art.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., components, devices, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, any use of the terms "first," "second," etc., do not denote any order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not different from the literal language of the claims, or if they include equivalent structural elements with insubstantial differences from the literal language of the claims.

APPENDIX A is a document that describes aspects of the claimed subject matter, and this Appendix forms part of this specification.

What is claimed is:

1. A setback platform system for a shared track rail system on a ground level that is used by a light rail transit vehicle and a freight vehicle, comprising:

a setback platform that is substantially parallel to the shared track rail system and is a first distance from a centerline of the shared track rail system;

a first path at a first height along and on top of the setback platform;

a shuttle platform coupled to the setback platform that actuates from a first position to a second position with a linear movement toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height;

in the first position, a portion of the shuttle platform is situated below the first path and the front edge is a second distance from the centerline;

in the second position, the portion of the shuttle platform is adjacent to the first path and the front edge is a third distance from the centerline;

the shuttle platform provides a path in the second position to allow passengers to board the light rail transit vehicle; and the shuttle platform in the first position creates a second path that allows travel about the setback platform;

a drive component configured to actuate the shuttle platform; and wherein the shuttle platform is configured to receive a remote signal communicated from the light rail transit vehicle to activate the linear movement of the shuttle platform from at least one of the first position to the second position or the second position to the first position.

2. The setback platform system of claim 1, further comprising a support structure that is incorporated into the setback platform and affixed to the ground level to provide structural support to the shuttle platform.

3. The setback platform system of claim 1, further comprising a guide system that is coupled to the shuttle platform for the linear movement.

4. The setback platform system of claim 1, further comprising a motion sensor that is configured to detect a movement in an area between the front edge and the centerline, wherein the drive component is disabled based on a detection of the movement.

5. The setback platform system of claim 1, further comprising:

an audible alert that is activated during the linear movement from at least one of the first to the second position or the second position to the first position;

a railing affixed to at least one of the first path or the shuttle platform; and a visible alert that is activated during the linear movement from at least one of the first to the second position or the second position to the first position.

6. The setback platform system of claim 1, where the first distance is approximately nine feet.

7. The setback platform system of claim 1, where the second distance is approximately nine feet.

8. The setback platform system of claim 1, where the third distance is between five feet six inches and five eight inches.

9. A setback platform system for a shared track rail system on a ground level that is used by a light rail transit vehicle and a freight vehicle, comprising:

a setback platform that is substantially parallel to the shared track rail system and is a first distance from a centerline of the shared track rail system;

a first path at a first height along and on top of the setback platform;

a shuttle platform coupled to the setback platform that actuates from a first position to a second position with a linear movement toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height;

in the first position, a portion of the shuttle platform is situated below the first path and the front edge is a second distance from the centerline;

in the second position, the portion of the shuttle platform is adjacent to the first path and the front edge is a third distance from the centerline;

the shuttle platform provides a path in the second position to allow passengers to board the light rail transit vehicle; and the shuttle platform in the first position creates a second path that allows travel about the setback platform; and a solenoid device that controls a physical connection between a bottom portion of the shuttle platform and a guide system that is actuated in the linear movement with a screw drive.

10. The setback platform system of claim 9, further comprising:

a disconnect device that disconnects the physical connection between a bottom portion of the shuttle platform and the guide system to prevent the screw drive from providing the linear movement; and the disconnect device connects a gear mechanism that is configured to provide linear movement rather than the screw drive.

11. A setback platform system for a shared track rail system on a ground level that is used by a light rail transit vehicle and a freight vehicle, comprising:

a setback platform that is substantially parallel to the shared track rail system and is approximately nine feet from a centerline of the shared track rail system;

a first path at a first height along and on top of the setback platform;

a shuttle platform coupled to the setback platform that actuates from a first position to a second position with a linear movement toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height;

in the first position, a portion of the shuttle platform is situated below the first path and the front edge is approximately nine feet from the centerline;

in the second position, the portion of the shuttle platform is adjacent to the first path and the front edge is a distance from the centerline, wherein the distance is between five feet six inches and five eight inches;

the shuttle platform provides a path in the second position to allow passengers to board the light rail transit vehicle;

the shuttle platform in the first position creates a second path that allows travel about the setback platform;

a support structure that is incorporated into the setback platform and affixed to the ground level to provide structural support to the shuttle platform;

a guide system that is coupled to the shuttle platform for the linear movement;

a drive component that is configured to actuate the shuttle platform on the guide system; and a motion sensor that is configured to detect a movement in an area between the front edge and the centerline, wherein the drive component is disabled based on a detection of the movement; and wherein the shuttle platform is configured to receive a remote signal communicated from the light rail transit vehicle to activate the linear movement of the shuttle platform from at least one of the first position to the second position or the second position to the first position.

12. The setback platform system of claim 11, further comprising:

an audible alert that is activated during the linear movement from at least one of the first to the second position or the second position to the first position;

a railing affixed to at least one of the first path or the shuttle platform; and a visible alert that is activated during the linear movement from at least one of the first to the second position or the second position to the first position.

13. A setback platform system for a shared track rail system on a ground level that is used by a light rail transit vehicle and a freight vehicle, comprising:

a setback platform that is substantially parallel to the shared track rail system and is approximately nine feet from a centerline of the shared track rail system;

a first path at a first height along and on top of the setback platform;

a shuttle platform coupled to the setback platform that actuates from a first position to a second position with a linear movement toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height;

in the first position, a portion of the shuttle platform is situated below the first path and the front edge is approximately nine feet from the centerline;

in the second position, the portion of the shuttle platform is adjacent to the first path and the front edge is a distance from the centerline, wherein the distance is between five feet six inches and five eight inches;

the shuttle platform provides a path in the second position to allow passengers to board the light rail transit vehicle;

the shuttle platform in the first position creates a second path that allows travel about the setback platform;

a support structure that is incorporated into the setback platform and affixed to the ground level to provide structural support to the shuttle platform;

a guide system that is coupled to the shuttle platform for the linear movement;

a drive component that is configured to actuate the shuttle platform on the guide system; and a motion sensor that is configured to detect a movement in an area between the front edge and the centerline, wherein the drive component is disabled based on a detection of the movement; and a solenoid device configured to control a physical connection between a bottom portion of the shuttle platform and a guide system that is actuated in the linear movement with a screw drive.

14. The setback platform system of claim 13, further comprising:

a disconnect device that disconnects the physical connection between a bottom portion of the shuttle platform and the guide system to prevent the screw drive from providing the linear movement; and the disconnect device connects a gear mechanism that is configured to provide linear movement rather than the screw drive.

15. The setback platform system of claim 13, further comprising a controller component that locks a physical barrier affixed to a surface of the shuttle platform while the shuttle platform is in the first position and unlocks the physical barrier while the shuttle platform is in the second position.

16. A setback platform system for a shared track rail system on a ground level that is used by a light rail transit vehicle and a freight vehicle, comprising:

a setback platform that is substantially parallel to the shared track rail system and is approximately nine feet from a centerline of the shared track rail system;

a first path at a first height along and on top of the setback platform;

a shuttle platform coupled to the setback platform that actuates from a first position to a second position with a linear movement via a guide system driven by a drive component toward the centerline or from a second position to the first position with a linear movement away from the centerline in a plane that is parallel to the ground level, the shuttle platform is at a second height along and on top of the setback platform and includes a front edge, a rear edge opposite thereto, and a thickness, wherein the first height is greater than the second height;

the shuttle platform includes a top section positioned above a bottom section, wherein the top section and the bottom section are integrated into the setback platform and the bottom section includes the guide system;

in the first position, a portion of the shuttle platform is situated below the first path and the front edge is approximately nine feet from the centerline;

in the second position, the portion of the shuttle is adjacent to the first path and the front edge is a distance from the centerline, wherein the distance is between five feet six inches and five eight inches;

the shuttle platform provides a path in the second position to allow passengers to board the light rail transit vehicle; and the shuttle platform in the first position creates a second path that allows travel about the setback platform; and a solenoid device configured to control a physical connection between a bottom portion of the shuttle platform and a guide system that is actuated in the linear movement with a screw drive.

* * * * *